US006677921B2

(12) United States Patent
Kang et al.

(10) Patent No.: US 6,677,921 B2
(45) Date of Patent: Jan. 13, 2004

(54) METHOD OF DRIVING PLASMA DISPLAY PANEL

(75) Inventors: Kyoung-ho Kang, Asan (KR); Shigeo Mikoshiba, Tokyo (JP); Tomokazu Shiga, Kanagawa-ken (JP); Kiyoshi Igarashi, Tokyo (JP); Makoto Ishii, Tokyo (JP); Nam-sung Jung, Kwangmyeong (KR); Hee-hwan Kim, Cheonan (KR); Seong-charn Lee, Seoul (KR); Joo-yul Lee, Chungcheongnam-do (KR)

(73) Assignee: Samsung SDI Co., Ltd., Suwon (KR)

( * ) Notice: Subject to any disclaimer, the term of this patent is extended or adjusted under 35 U.S.C. 154(b) by 184 days.

(21) Appl. No.: 09/922,767

(22) Filed: Aug. 7, 2001

(65) Prior Publication Data

US 2002/0033781 A1 Mar. 21, 2002

(30) Foreign Application Priority Data

Sep. 21, 2000 (KR) ..... 2000-55476

(51) Int. Cl.[7] ..... G09G 3/28
(52) U.S. Cl. ..... 345/60; 315/169.4
(58) Field of Search ..... 345/60, 61, 62, 345/63, 55, 66, 68, 74.1, 76; 313/484, 491, 514, 517, 520; 315/167, 168, 169.1, 169.4

(56) References Cited

U.S. PATENT DOCUMENTS 6,292,160 B1 9/2001 Mikoshiba et al. ..... 345/60
6,489,939 B1 * 12/2002 Asao et al. ..... 345/65
6,492,964 B1 * 12/2002 Mikoshiba et al. ..... 345/60

FOREIGN PATENT DOCUMENTS

| | | |
|---|---|---|
| EP | 0 938 073 A2 | 8/1999 |
| EP | 0 938 073 A3 | 8/2000 |
| FR | 2 763 731 A1 | 11/1998 |

OTHER PUBLICATIONS

U.S. patent application Ser. No. 09/081,827 filed May 20, 1998, Inventors: Mikoshiba, Shigeo et al., Title: "Plasma Display Panel And Driving Method Thereof".

* cited by examiner

*Primary Examiner*—Vijay Shankar
*Assistant Examiner*—Mansour M. Said
(74) *Attorney, Agent, or Firm*—McGuireWoods LLP

(57) ABSTRACT

A method of driving a plasma display panel having front and rear substrates disposed opposite each other, parallel X and Y electrode lines formed between the front and rear substrates, and address electrode lines formed orthogonal to the X and Y electrode lines to define corresponding discharge cells at interconnections, the X electrode lines are in X groups, and the Y electrode lines are in Y groups, where no two adjacent pairs of adjacent X and Y electrode lines belong to the same pair of X and Y groups. The X and Y electrode lines of the respective X and Y groups are commonly connected to be driven, and at least first and second subfields are driven in an overlapping manner for displaying gray scales during a unit display period. The method includes a scan step, an address step, a display step, a second driving step, and a repetition step.

23 Claims, 16 Drawing Sheets

METHOD OF DRIVING PLASMA DISPLAY PANEL

CROSS-REFERENCE TO RELATED APPLICATIONS

This application claims the benefit of Korean Application No. 2000-55476, filed Sep. 21, 2000, in the Korean Industrial Property Office, the disclosure of which is incorporated herein by reference.

BACKGROUND OF THE INVENTION

1. Field of the Invention

The present invention relates to a method of driving a plasma display panel, and more particularly, to a method of driving a three-electrode surface-discharge plasma display panel.

2. Description of the Related Art

FIG. 1 shows a structure of a conventional three-electrode surface-discharge plasma display panel, and FIG. 2 shows an electrode line pattern of the plasma display panel shown in FIG. 1. Referring to FIGS. 1 and 2, address electrode lines $A_{R1}$, $A_{G1}$, . . . , $A_{Gm}$, $A_{Bm}$, dielectric layers 11 and 15, Y electrode lines $Y_1$, $Y_2$, . . . . $Y_n$, X electrode lines $X_1$, $X_2$, . . . , and $X_n$, phosphors 16, partition walls 17, and an MgO protective film 12 are provided between front and rear glass substrates 10 and 13 of a conventional surface-discharge plasma display panel 1.

The address electrode lines $A_{R1}$, $A_{G1}$, . . . , $A_{Gm}$, $A_{Bm}$ are coated over the front surface of the rear glass substrate 13 in a predetermined pattern. The lower dielectric layer 15 is coated over the entire front surface of the address electrode lines $A_{R1}$, $A_{G1}$, . . . , $A_{Gm}$, $A_{Bm}$. The partition walls 17 are formed on the front surface of the lower dielectric layer 15 to be parallel to the address electrode lines $A_{R1}$, $A_{G1}$, . . . , $A_{Gm}$, $A_{Bm}$. The partition walls 17 define discharge areas of the respective pixels and prevent optical crosstalk among pixels. The phosphors 17 are coated between partition walls 17.

The X electrode lines $X_1$, $X_2$, . . . $X_n$ and the Y electrode lines $Y_1$, $Y_2$, . . . $Y_n$ are arranged on the rear surface of the front glass substrate 10 in a predetermined pattern so as to be orthogonal to the address electrode lines $A_{R1}$, $A_{G1}$, . . . , $A_{Gm}$, $A_{Bm}$. The respective intersections define corresponding pixels. The X electrode lines $X_1$, $X_2$, . . . and $X_n$ and the Y electrode lines $Y_1$, $Y_2$, . . . $Y_n$ each comprise conductive indium tin oxide (ITO) electrode lines ($X_{na}$ and $Y_{na}$ of FIG. 2) and metal bus electrode lines ($X_{nb}$ and $Y_{nb}$ of FIG. 2). The upper dielectric layer 11 is coated over the entire rear surface of the X electrode lines $X_1$, $X_2$, . . . $X_n$ and the Y electrode lines $Y_1$, $Y_2$, . . . $Y_n$. The MgO protective film 12 protects the panel 1 against strong electrical fields and is coated over the entire rear surface of the upper dielectric layer 11. A gas to form a plasma is hermetically sealed in a discharge space 14.

The above-described plasma display panel is basically driven such that a reset step, an address step, and a display step are sequentially performed in a unit subfield. In the reset step, wall charges remaining in the previous subfield are erased and space charges are evenly formed. In the address step, the wall charges are formed in a selected pixel area. In the display step, light is produced at the pixel at which the wall charges are formed in the address step. In other words, if alternating pulses of a relatively high voltage are applied between the X electrode lines $X_1$, $X_2$, . . . $X_n$ and the Y electrode lines $Y_1$, $Y_2$, . . . $Y_n$, a surface discharge occurs at the pixels at which the wall charges are formed. The plasma is formed at the gas in the discharge space 14, and the phosphors 16 are excited by ultraviolet rays to thus emit the light.

In the above-described driving method, in order to perform gray scale display on a plasma display panel, a time-divisional driving method is used in which a frame, which is a unit display period, is divided into subfields, each subfield having different display times to display gray scales. For example, when displaying 256 gray scales by 8-bit image data in units of frames, 8 subfields are set to each frame (in the case of a sequential driving method) or field (in the case of a non-interlaced driving method). Here, according to the method of arranging the respective subfields on a unit display period, there are an address-display separation driving method and an address-while-display driving method.

According to the address-display separation driving method, since the time regions of the respective subfields are separated in a unit display period, the time regions of an address period and a display period are also separated in each subfield. Thus, in an address period, a pair of X and Y electrode lines must wait until the other pairs of X and Y electrode lines are all addressed even after the pertinent pair of X and Y electrode lines are addressed. Thus, the time for the address period increases for each subfield, which relatively reduces the time for a display period. Although the address-display separation driving method is advantageous in that the driving circuit and algorithm are simple, the luminance of a plasma display panel driven based on this method is disadvantageously low.

According to the address-while-display driving method, since the time regions of the respective subfields overlap in a unit display period, the time regions of the address and display periods in the respective subfields also overlap. Thus, immediately after addressing of each pair of X and Y electrode lines is performed in an address period, a display discharge step is performed. Since the time for the address period of each subfield is reduced, the display period is relatively increased. Although the address-while-display driving method is disadvantageous in that the driving circuit and algorithm are complex, the luminance of light emitted from a plasma display panel driven based on this method is advantageously increased.

SUMMARY OF THE INVENTION

To solve the above and other problems, it is an object of the present invention to provide a method of driving a plasma display panel which can reduce the number of driving devices of X and Y driving circuits and can enhance the luminance of the light emitted from the plasma display panel by using an address-while-display driving method.

Additional objects and advantages of the invention will be set forth in part in the description which follows and, in part, will be obvious from the description, or may be learned by practice of the invention.

Accordingly, to achieve the above and other objects, there is provided a method of driving a plasma display panel according to an embodiment of the present invention, the plasma display panel having front and rear substrates disposed opposite each other, X and Y electrode lines formed parallel to each other between the front and rear substrates, and address electrode lines formed orthogonal to the X and Y electrode lines to define corresponding a discharge cell at interconnections, where the X electrode lines are divided into X groups and the Y electrode lines are divided into Y groups such that no two adjacent pairs of adjacent X and Y electrode lines belong to the same pair of X and Y groups and the X and Y electrode lines of the respective X and Y groups are commonly connected to be driven, and at least first and second subfields are driven in an overlapping manner to display gray scales during a unit display period, the method includes a scan operation to form wall charges around a first pair of X and Y electrode lines for a first subfield, an address operation to erase wall charges as non-selected discharge cells, a display operation to generate light at selected discharge cells in the subfield, a second driving operation of performing the scan, address, and display operations for a second pair of X and Y electrode lines of a second subfield at different timing points, and a repetition operation of performing the scan, address, display, and second driving operations for the remaining pairs of X and Y electrode lines of the first and second subfields.

According to an aspect of the present invention, the scan operation includes applying a Y scan pulse of a first polarity to the Y electrode lines of a first pair of X and Y groups to which the pair of X and Y electrode lines of the first subfield belong, and an X scan pulse of a second polarity opposite to the first polarity to the X electrode lines of the first pair of X and Y groups to form the wall charges in the discharge space around the first pair of X and Y electrode lines.

According to another aspect of the present invention, the address operation includes applying a data signal corresponding to the first pair of X and Y electrode lines of the first subfield to all the address electrode lines to erase the wall charges formed at the unselected discharge cells.

According to a further aspect of the present invention, the display operation includes applying display pulses alternately to the X and Y electrode lines of the first pair of X and Y groups to cause a display discharge at the selected discharge cells having wall charges.

According to a still further aspect of the present invention, the second driving operation includes performing the scan, the address, and the display operations for a first or second pair of X and Y groups to which the second pair of X and Y electrode lines of the second subfield belong, the address operation being performed at different timing points from the timing points of the first pair of X and Y groups of the first subfield.

According to a yet further aspect, the repetition operation comprises repeatedly performing the scan, the address, the display, and the second driving operations for pairs of X and Y groups to which the remaining pairs of X and Y electrode lines of the first and second subfields belong.

BRIEF DESCRIPTION OF THE DRAWINGS

The above and other objects and advantages of the present invention will become more apparent and more readily appreciated by describing in detail the preferred embodiments, with reference to the attached drawings in which.

DETAILED DESCRIPTION OF THE PREFERRED EMBODIMENTS

Figure 1:
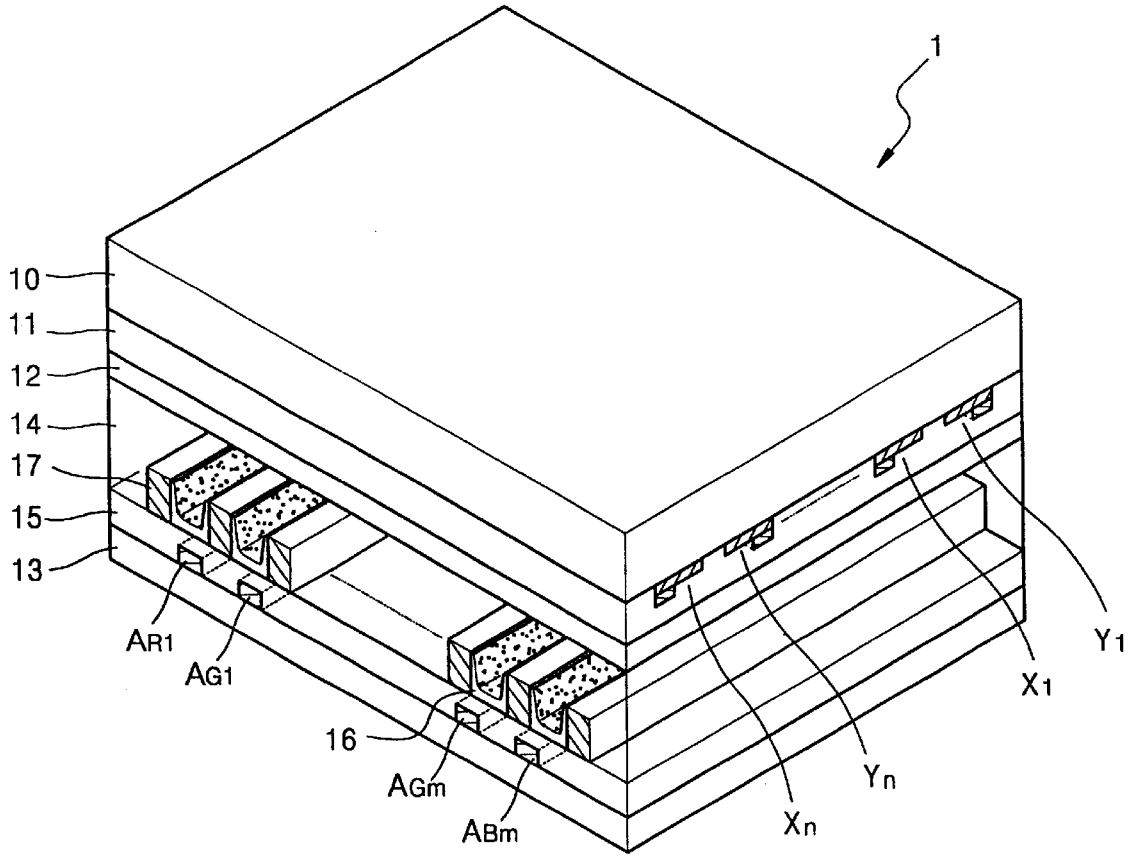
FIG. 1 (PRIOR ART)
FIG. 1 shows an internal perspective view illustrating a structure of a conventional three-electrode surface-discharge plasma display panel.
Figure 2:
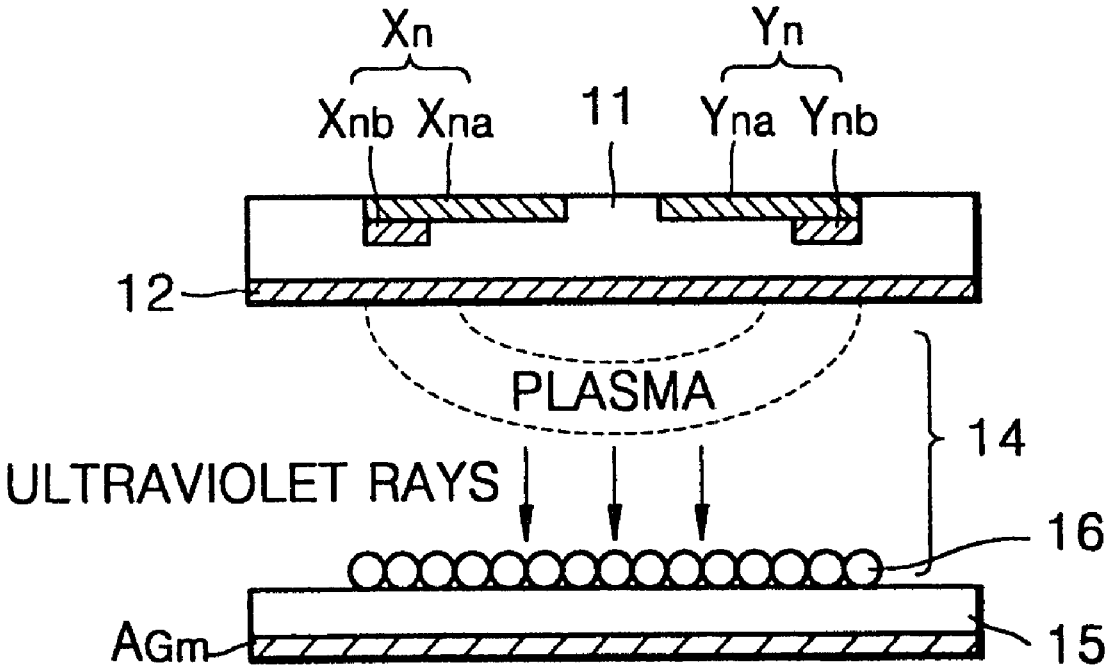
FIG. 2 (PRIOR ART)
FIG. 2 is a cross section of an example of a pixel of the conventional plasma display panel shown in FIG. 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
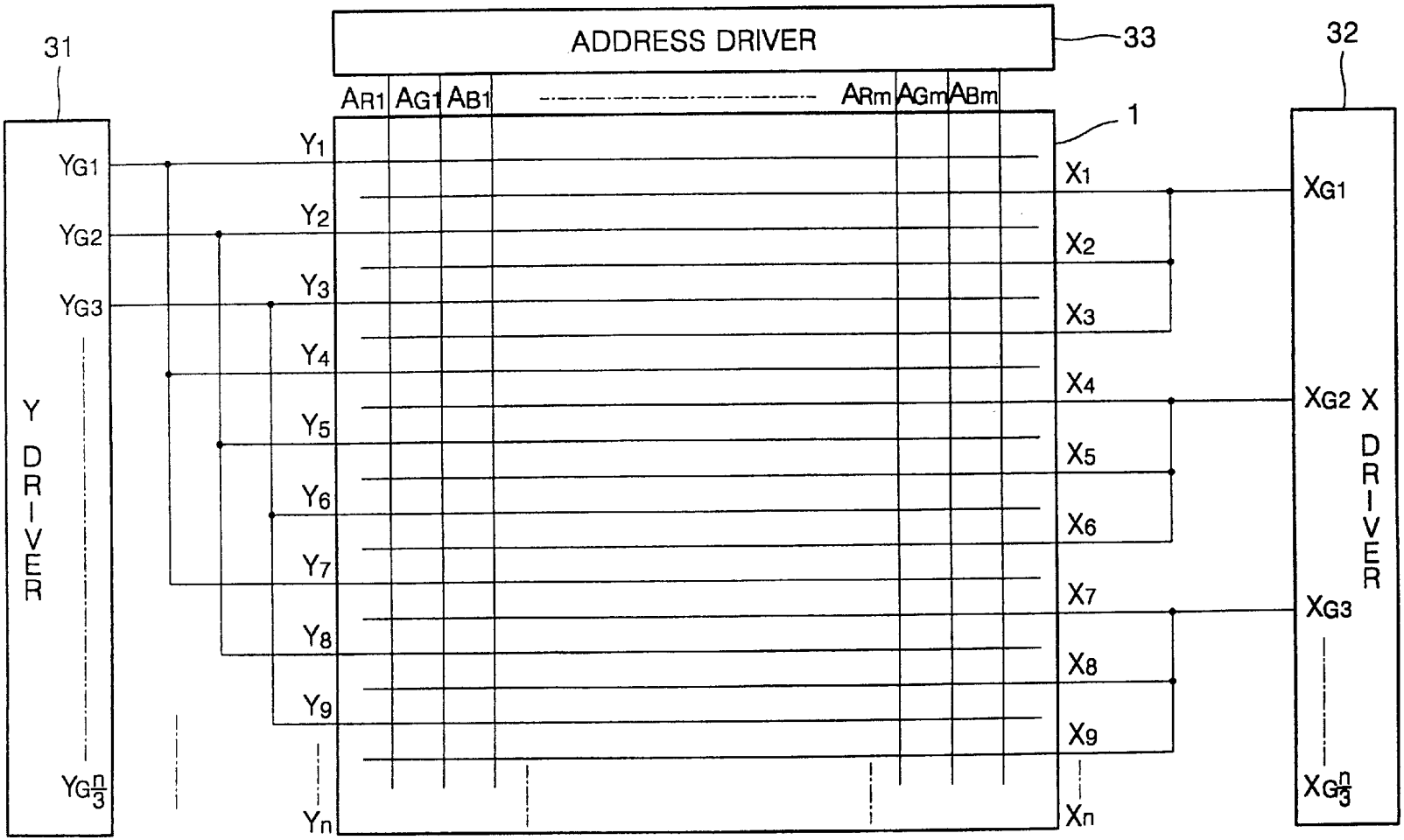
FIG. 3 is a connection diagram of X and Y electrode lines of a plasma display panel according to an embodiment of the present invention.

FIG. 3 is a connection diagram of electrode lines of a plasma display panel based on a driving method according to the present invention. X electrode lines $X_1, X_2, \ldots X_n$ are divided into "n/3" X groups $X_{G1}, X_{G2}, \ldots X_{Gn/3}$ (where n is a number of pairs of X and Y electrode lines) and the Y electrode lines $Y_1$ and $Y_2, \ldots Y_n$ are also divided into "n/3" X groups $Y_{G1}$ and $Y_{G2}, \ldots {}_{YGn/3}$. The X and Y electrode lines of the respective X and Y groups are commonly connected to be driven by output driving devices of X and Y drivers 31 and 32. Here, the respective pairs of X and Y groups to which the respective pairs of adjacent X and Y electrode lines $X_1Y_1, X_2Y_2, \ldots X_nY_n$ belong (i.e., $X_{G1}Y_{G1}$, $X_{G1}Y_{G2}$, $X_{G1}Y_{G3}$, $X_{G2}Y_{G1}$, $X_{G2}Y_{G2}$, $X_{G2}Y_{G3}$, $X_{G3}Y_{G1}$, $X_{G3}Y_{G2}$, $X_{G3}Y_{G3}, \ldots$) are all different. While not shown, it is understood that the X and Y electrode lines can be divided into other groups, such as n/4, n/5 . . . groups.

In a state in which the X and Y electrode lines are connected in such a manner, an AND-logic driving method, which will be described below, and an address-while-display driving method, are performed according to an embodiment of the present invention, thereby reducing the numbers of output driving devices of the X and Y drivers 31 and 32 to ⅓, respectively, and enhancing the luminance of light emitted from a plasma display panel 1. In addition to the X and Y drivers 31 and 32, an address driver 33 drives address electrode lines $A_{R1}, A_{G1}, A_{B1}, \ldots A_{Rm}, A_{Gm}, A_{Bm}$. A controller (not shown) contains the driving circuit or algorithm to control the X, Y, and address drivers 31–33 to implement the address-while-display driving method.

Figure 4:
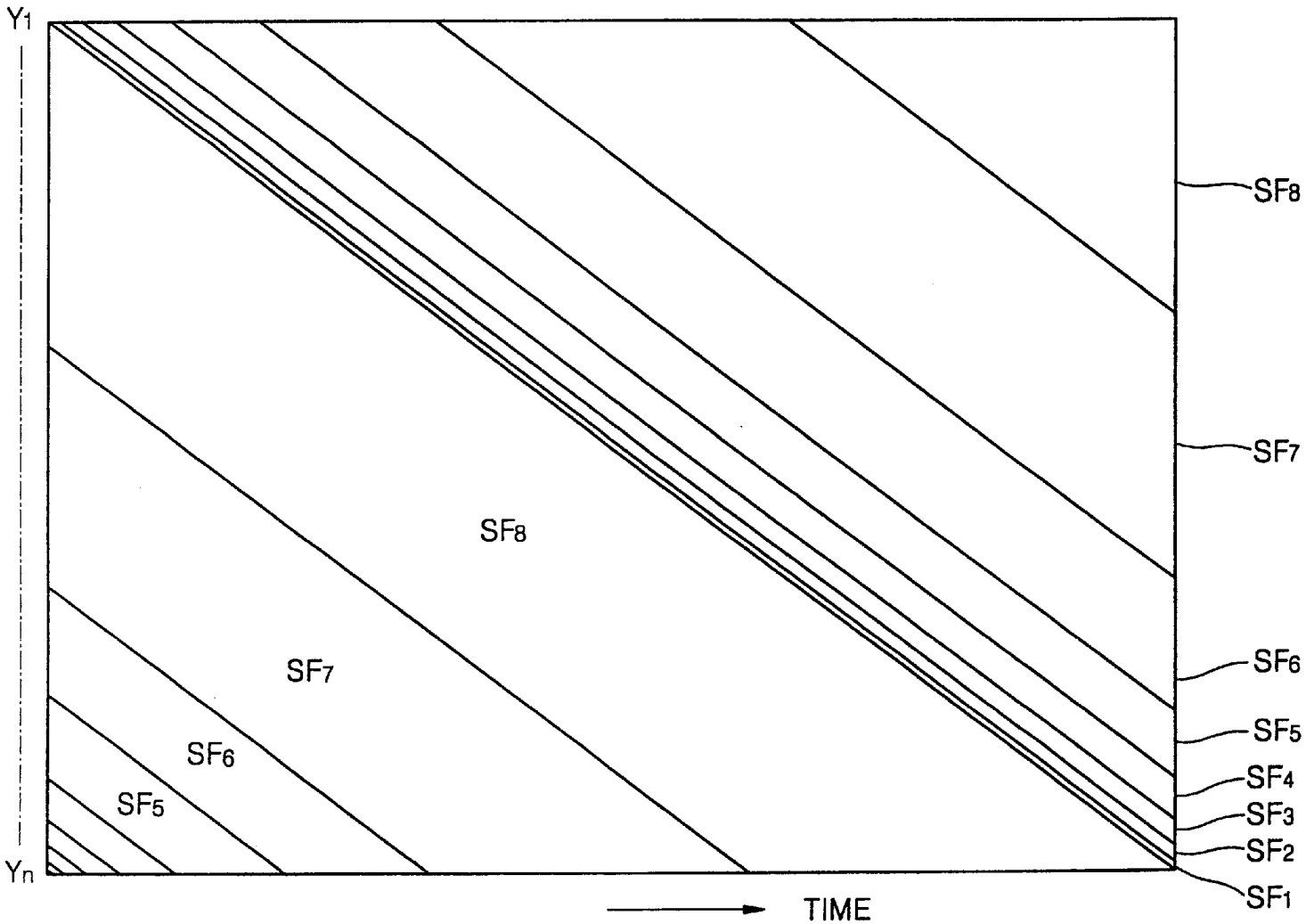
FIG. 4 is a timing diagram showing the structure of a unit display period based on an address-while-display driving method according to an embodiment of the present invention.

FIG. 4 is a timing diagram showing the structure of a unit display period based on an address-while-display driving method according to an embodiment of the present invention. Display pulses are continuously applied to the X and Y electrode lines belonging to all the X and Y groups, and scan and address pulses are applied between each of the display pulses. In other words, in a unit subfield, scan and address operations are sequentially performed with respect to the X and Y electrode lines of a pair of X and Y groups to which individual pairs of X and Y electrode lines belong, and a display operation is performed for the remaining time. Here, the order of pairs of X and Y electrode lines for scanning and addressing is determined by the driving order of subfields. For example, after X and Y electrode lines of a pair of X and Y groups to which a pair of X and Y electrode lines of a first subfield SF, belong are driven, X and Y electrode lines of a pair of X and Y groups to which a pair of X and Y electrode lines of a second subfield $SF_2$ belong are then driven. Likewise, if X and Y electrode lines of a pair of X and Y groups to which a pair of X and Y electrode lines of an eighth subfield $SF_8$ belong are driven, X and Y electrode lines of a pair of X and Y groups to which another pair of X and Y electrode lines of a first subfield SF, belong are driven.

Referring to FIG. 4, a unit field or frame is divided into 8 subfields $SF_1, SF_2, \ldots SF_8$ to achieve a time-divisional gray scale display. While not shown, in each subfield, reset, address and sustain-discharge operations are performed. The time allocated to each sub-field is determined by the display discharge time corresponding to gray scales. For example, in the case of displaying 256 gray scales by 8-bit image data in units of frames, assuming that a unit frame (generally 1/60of a second) has 255 unit times, the first subfield SF, driven by the image data of the least significant bit has 1 ($2^0$) unit time, the second subfield $SF_2$ 2 ($2^1$) unit times, the third subfield $SF_3$ 4 ($2^2$) unit times, the fourth subfield $SF_4$ 8 ($2^3$) unit times, the fifth subfield $SF_5$ 16 ($2^4$) unit times, the sixth subfield $SF_6$ 32 ($2^5$) unit times, the seventh subfield $SF_7$ 64 ($2^6$) unit times, and the eighth subfield $SF_8$ driven by the image data of the most significant bit 128 ($2^7$) unit time, respectively. In other words, since the sum of the unit times allocated to the respective subfields is 255 unit times, it is possible to achieve 255 gray scale display, and 256 gray scale display inclusive of one gray scale in which a no display discharge occurs in any subfield. Here, the time for a unit subfield is equal to the time for a unit frame. However, the respective unit subfields overlap based on a pair of driven X and Y electrode lines to form a unit frame.

The numbers of output driving devices for the X and Y drivers 31 and 32 are reduced by ⅔ by using the address-while-display driving method to the connection method shown in FIG. 3. Also, the luminance of the light emitted from the plasma display panel 1 can be enhanced.

Figures 5A, 5B, 5C:
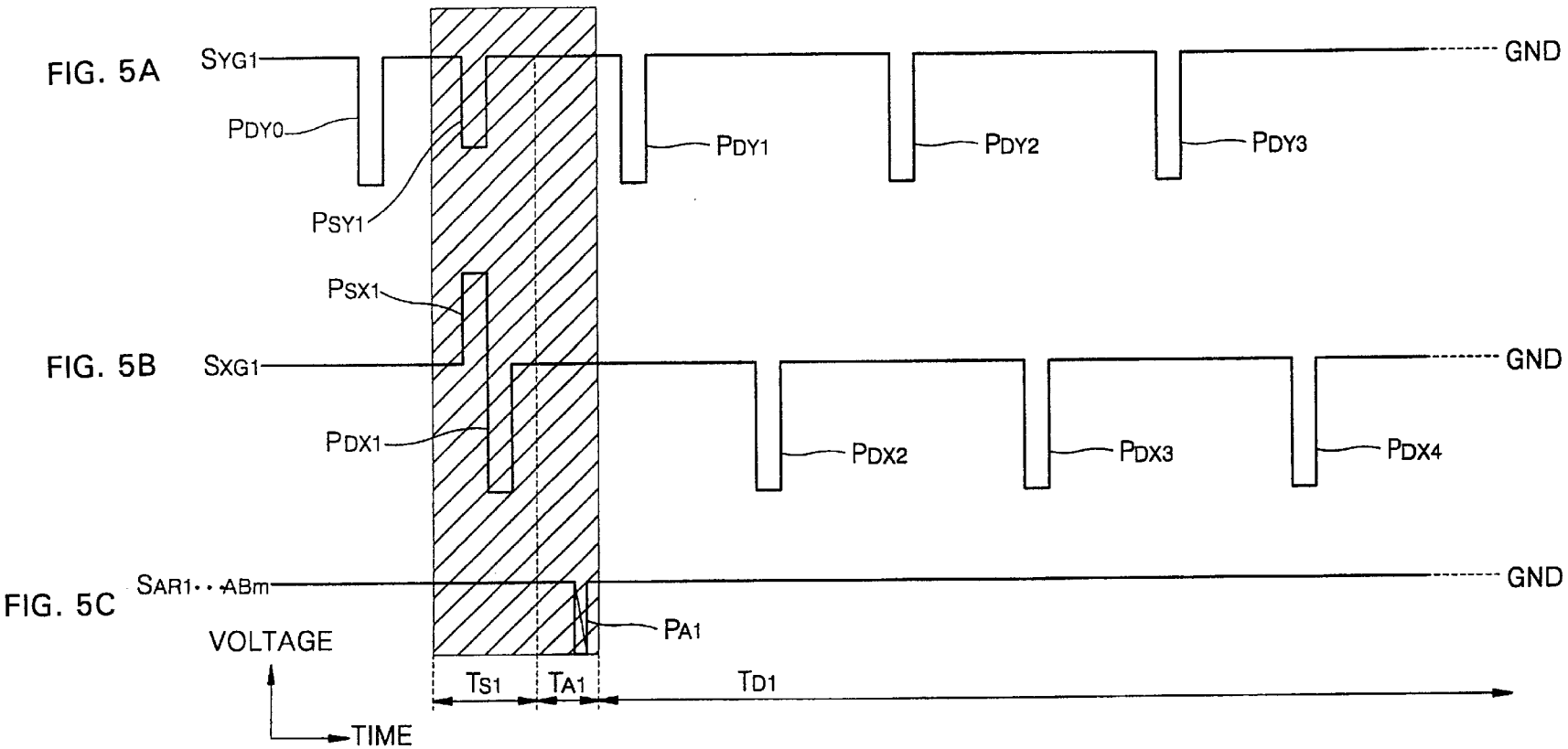
FIGS. 5A through 5C are waveform diagrams of the driving signals applied to pairs of X and Y electrode groups $X_{G1}$ and $Y_{G1}$ to which a first pair of X and Y electrode lines $X_1$ and $Y_1$ shown in FIG. 3 belong, according to an embodiment of the present invention.

FIGS. 5A through 5C show waveform diagrams of driving signals applied to a pair of X and Y electrode groups $X_{G1}$ and $Y_{G1}$ to which a first pair of X and Y electrode lines $X_1$ and $Y_1$ shown in FIG. 3 belong according to a first embodiment of the present invention. In FIGS. 5A through 5C, $S_{YG1}$, denotes a driving signal of a first Y group $Y_{G1}$, $S_{XG1}$ denotes a driving signal of a first X group $X_{G1}$, and $S_{AR1 \ldots ABM}$ denotes data signals applied to corresponding address electrode lines ($A_{R1}, A_{G1}, A_{B1}, \ldots A_{Rm}, A_{Gm}, A_{Bm}$ of FIG. 3). Y display pulses $P_{DY1}, P_{DY2}, \ldots$ and X display pulses $P_{DX1}, P_{DX2}, \ldots$ are alternately applied to the first pair of X and Y groups $X_{G1}$ and $Y_{G1}$. A scan period $T_{S1}$ and an address period $T_{A1}$ for the first pair of X and Y electrode lines $X_1$ and $Y_1$ of a subfield (one of the subfields $SF_1$, $SF_2, \ldots SF_8$ of FIG. 4) are set during the time between a Y display pulse $P_{DY0}$ and a first Y display pulse $P_{DY1}$. Reference mark $T_{D1}$ denotes a display period for the first pair of X and Y electrode lines $X_1$ and $Y_1$ of the pertinent subfield.

During a scan period $T_{S1}$ for a pair of X and Y electrode lines (e.g., the first pair of X and Y electrode lines $X_1$ and $Y_1$) a negative-polarity Y scan pulse $P_{SY1}$ is applied to the Y electrode lines ($Y_1$, $Y_4$ and $Y_7$ of FIG. 3) of the pair of X and Y groups $X_{G1}$ and $Y_{G1}$ to which the pair of the X and Y electrode lines $X_1$ and $Y_1$ belong. In addition, a positive-polarity X scan pulse $P_{SX1}$ is applied to the X electrode lines ($X_1$, $X_2$ and $X_3$ of FIG. 3) of the X group $X_{G1}$. Accordingly, positive-polarity wall charges are formed in the discharge space around the first Y electrode line $Y_1$, and negative-polarity wall charges are formed in the discharge space around the first X electrode line $X_1$. When the scan pulses $P_{SY1}$ and $P_{SX1}$ are terminated, a voltage is applied between the first pair of X and Y electrode lines $X_1$ and $Y_1$ due to the wall charges. Thus, a discharge is performed between the pair of X and Y electrode lines $X_1$ and $Y_1$ by the negative-polarity display pulse $P_{DX1}$ applied to the first X group $X_{G1}$, so that negative-polarity wall charges are formed in the discharge space around the first Y electrode line $Y_1$ and positive-polarity wall charges are formed in the discharge space around the first X electrode line $X_1$.

During a subsequent address period $T_{A1}$, data signals $S_{AR1 \ldots ABm}$ are applied to address electrode lines $A_{R1}, A_{G1}, A_{B1}, \ldots A_{Rm}, A_{Gm}, A_{Bm}$, so that wall charges formed at unselected discharges are erased. In other words, as a negative-polarity data pulse $P_{A1}$ is applied to the address electrode lines of the unselected discharge cells, the wall charges formed at unselected discharge cells are erased.

During a subsequent display period $T_{D1}$, display pulses $P_{DY1}$, $P_{DX2}$, $P_{DY2}$, $P_{DX3}$, $P_{DY3}$, $P_{DX4}$, . . . are alternately applied to the X and Y electrode lines of the pair of X and Y groups $X_{G1}$ and $Y_{G1}$ (i.e., the groups $X_{G1}$ and $Y_{G1}$ to which the first pair of X and Y electrode lines $X_1$ and $Y_1$ belong) so that a display discharge occurs at selected discharge cells where wall charges are formed and have not been erased.

The driving procedure of the scan and address periods $T_{S1}$ and $T_{A1}$ is consistently performed with respect to the pair of X and Y groups to which a pair of X and Y electrode lines of another subfield belong. For example, during the time between first and second Y display pulse $P_{DY1}$ and $P_{DY2}$, scan and address steps are performed with respect to another pair of X and Y electrode lines of another subfield using another pair of X and Y groups to which the another pair of X and Y electrode lines belong. Also, during the time between second and third Y display pulse $P_{DY2}$ and $P_{DY3}$, scan and address steps are performed with respect to yet another pair of X and Y electrode lines of yet another subfield using a yet another corresponding pair of X and Y groups.

Figures 6A, 6B, 6C:
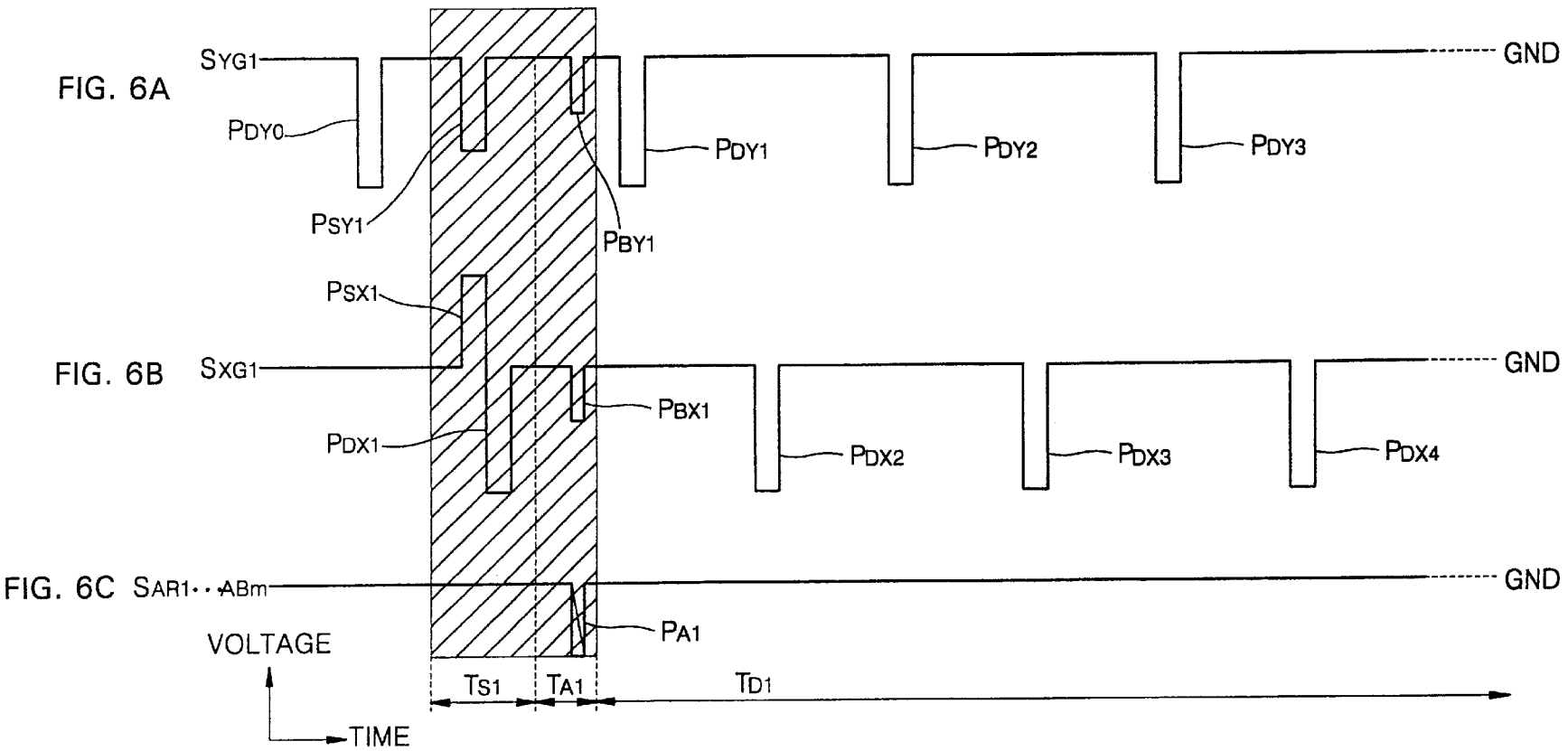
FIGS. 6A through 6C are waveform diagrams waveform diagram of the driving signals applied to pairs of X and Y electrode groups $X_{G1}$ and $Y_{G1}$ to which a first pair of X and Y electrode lines $X_1$ and $Y_1$ belong according to another embodiment of the present invention.
Figures 7A, 7B, 7C, 7D, 7E, 7F, 7G:
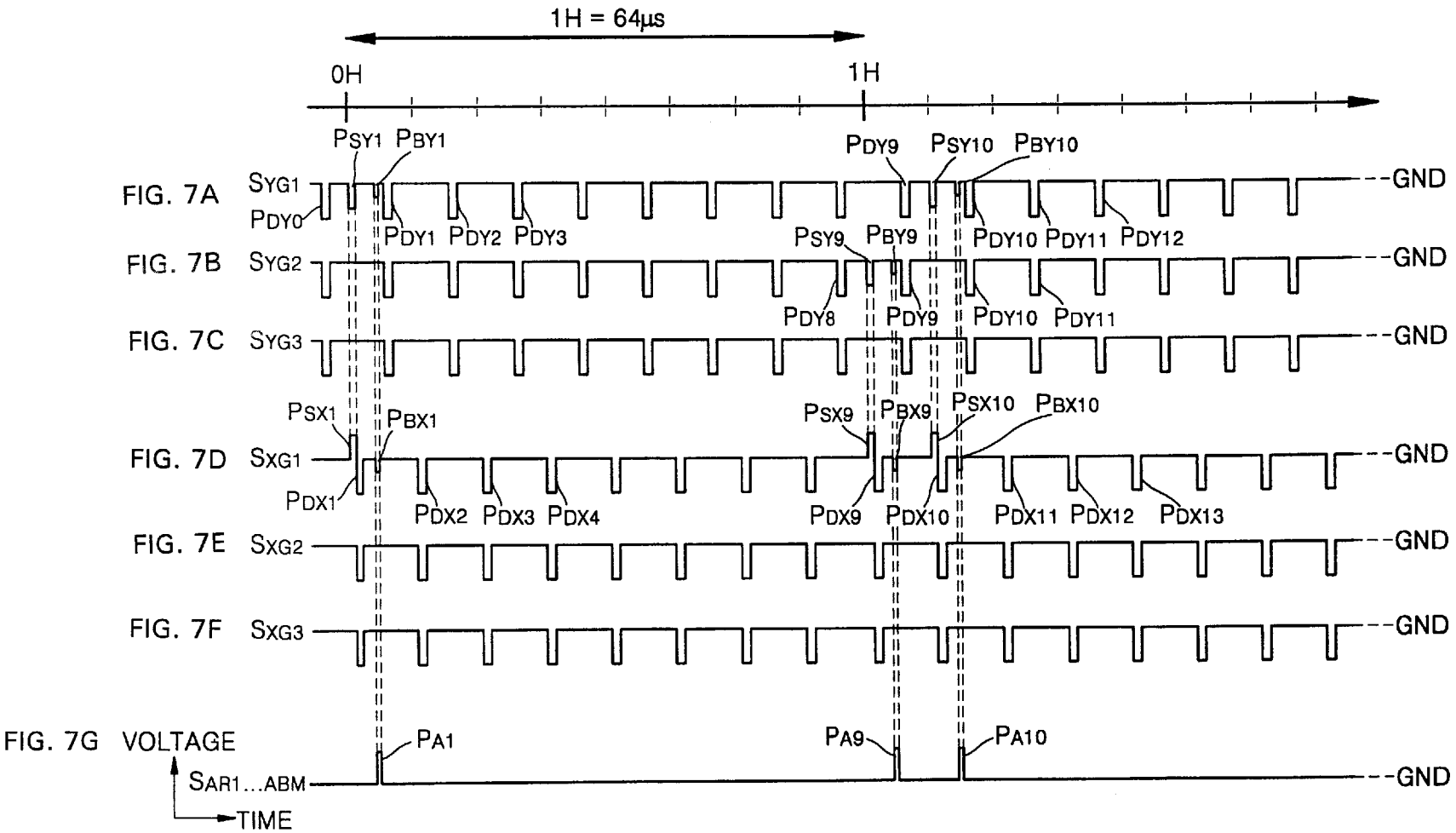
FIGS. 7A through 7G are timing diagrams illustrating the procedure for driving a first pair of X and Y electrode lines $X_1$ and $Y_1$ of a first subfield, a second pair of X and Y electrode lines $X_2$ and $Y_2$ of the first subfield and a first pair of X and Y electrode lines $X_1$ and $Y_1$ of a second subfield by the driving waveforms shown in FIGS. 6A through 6C.
Figures 8A, 8B, 8C, 8D, 8E, 8F, 8G:
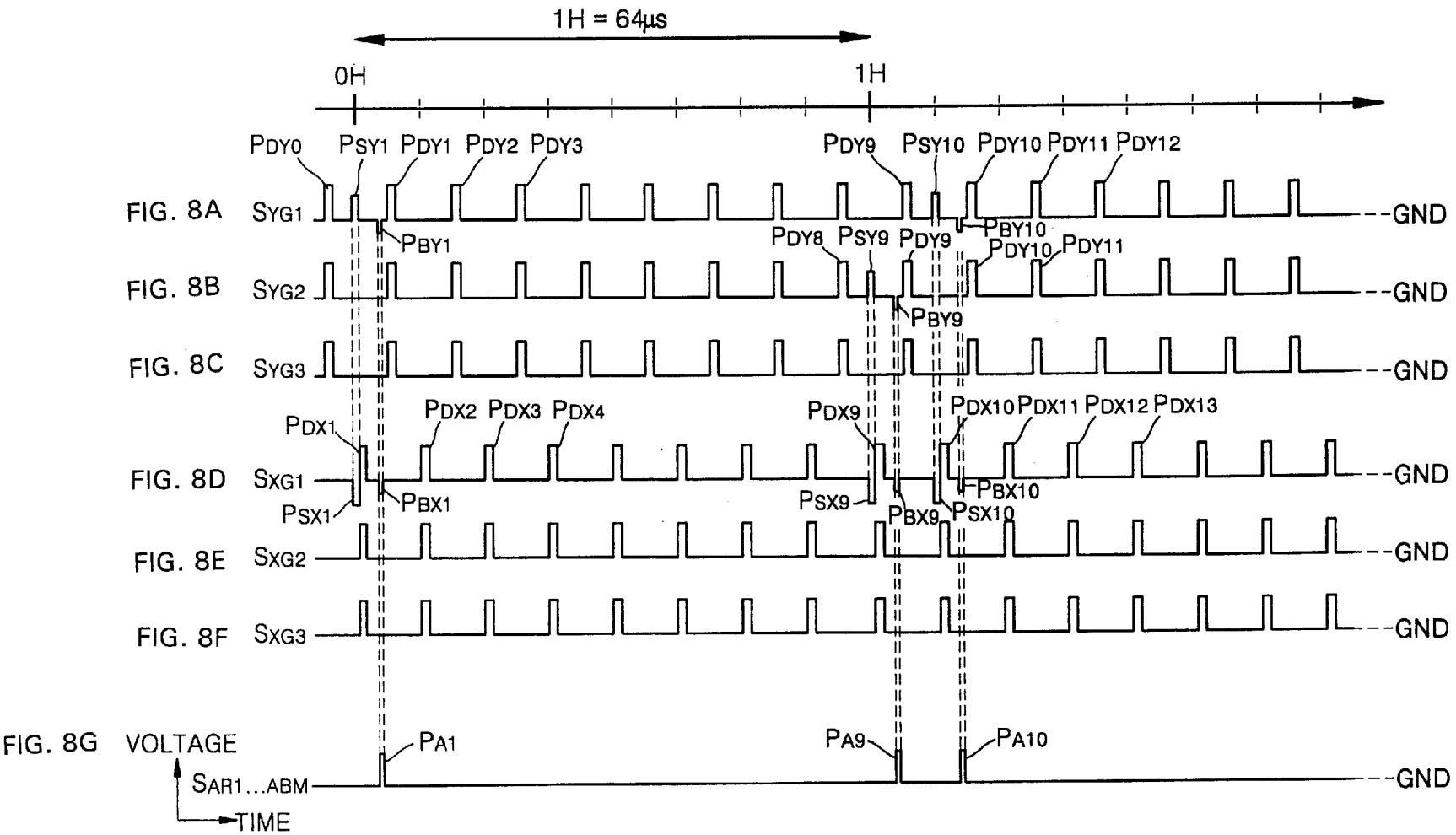
FIGS. 8A through 8G are timing diagrams illustrating the state in which the display pulses shown in FIGS. 7A through 7G have positive polarities.

FIGS. 6A through 6C are waveform diagrams of driving signals applied to the pair of X and Y electrode groups $X_{G1}$ and $Y_{G1}$ to which the first pair of X and Y electrode lines $X_1$ and $Y_1$ shown in FIG. 3 belong according to another embodiment of the present invention. In FIGS. 6A through 6C, the same symbols as those in FIGS. 5A through 5C denote the same functional elements. Referring to FIGS. 6A through 6C, in an address period $T_{A1}$, while the data pulse $P_{A1}$ of an address signal used to erase wall charges of unselected discharge cells is applied, bias pulses $P_{BX1}$ and $P_{BY1}$ having the same polarity as the data pulse $P_{A1}$ are applied to the X and Y electrode lines of X and Y electrode groups $X_{G1}$ and $Y_{G1}$. Accordingly, additional wall charges of unselected discharge cells can be erased.

FIGS. 7A through 7G are timing diagrams illustrating the procedure of driving a first pair of X and Y electrode lines ($Y_1$ and $X_1$ of FIG. 3) of a first subfield ($SF_1$ of FIG. 4), a second pair of X and Y electrode lines ($Y_2$ and $X_2$ of FIG. 3) of the first subfield SF, and a first pair of X and Y electrode lines ($Y_1$ and $X_1$ of FIG. 3) of a second subfield ($SF_2$ of FIG. 4), by the driving waveforms shown in FIGS. 6A through 6C. In FIGS. 7A through 7G, the same symbols as those in FIGS. 6A through 6C denote the same functional elements. Specifically, $S_{YG1}$ denotes the driving signal of the first Y group $Y_{G1}$, $S_{YG2}$ denotes a driving signal of a second Y group ($Y_{G2}$ of FIG. 3), $S_{YG3}$ denotes a driving signal of a third Y group ($Y_{G3}$ of FIG. 3), $S_{XG2}$ denotes a driving signal of a second X group ($X_{G2}$ of FIG. 3), and $S_{XG3}$ denotes a driving signal of a third X group ($X_{G3}$ of FIG. 3), respectively.

Referring to FIGS. 7A through 7G, scan and address periods for the first pair of X and Y electrode lines $X_1$ and $Y_1$ of the first subfield $SF_1$ are performed at the starting time of a first unit driving period ranging from 0H to 1H. Next, scan and address periods for a pair of X and Y electrode lines of a second $SF_2$ are performed during the time between first and second Y display pulses $P_{DY1}$ and $P_{DY2}$ (not shown). Then, scan and address periods for a pair of X and Y electrode lines of a third $SF_3$ are performed during the time between second and third Y display pulses $P_{DY2}$ and $P_{DY3}$ (not shown). Thus, scan and address periods for a pair of X and Y electrode lines of an eighth subfield ($SF_8$ of FIG. 4) are performed immediately before application of an eighth Y display pulse $P_{DY8}$ (not shown).

Next, scan and address periods for the second pair of X and Y electrode lines $X_2$ and $Y_2$ (which are common to a pair of X and Y groups $X_{G1}$ and $Y_{G2}$) of the first subfield $SF_1$ are performed at the starting time of a second unit driving period after 1H. Also, scan and address periods for the first pair of X and Y electrode lines $X_1$ and $Y_1$ (which are common to a pair of X and Y groups $X_{G1}$ and $Y_{G1}$) of the second $SF_2$ are performed during the time between ninth and tenth Y display pulses $P_{DY9}$ and $P_{DY10}$. Next, scan and address periods for a pair of X and Y electrode lines of a third $SF_3$ are performed during the time between tenth and eleventh Y display pulses $P_{DY10}$ and $P_{DY11}$ (not shown). Likewise, scan and address periods for a pair of X and Y electrode lines of a fourth $SF_4$ are performed during the time between eleventh and twelfth Y display pulses $P_{DY11}$ and $P_{DY12}$ (not shown).

FIGS. 8A through 8G are timing diagrams illustrating the state in which polarities of the display pulses shown in FIGS. 7A through 7G are converted into positive polarities. In FIGS. 8A through 8G, the same symbols as those in FIGS. 7A through 7G denote the same functional elements. Referring to FIGS. 8A through 8G, scan and address periods for the first pair of X and Y electrode lines $X_1$ and $Y_1$ of the first subfield ($SF_1$ of FIG. 4) are performed at the starting time of a first unit driving period ranging from 0H to 1H, which will now be described in detail. A positive-polarity Y scan pulse $P_{SY1}$ is applied to the Y electrode lines ($Y_1$, $Y_4$ and $Y_7$ of FIG. 3) of the pair of X and Y groups $X_{G1}$ and $Y_{G1}$ to which a pair of the X and Y electrode lines of the first subfield $SF_1$ (e.g., the first pair of X and Y electrode lines $X_1$ and $Y_1$) belong, and a negative-polarity X scan pulse $P_{SX1}$ is applied to the X electrode lines ($X_1$, $X_2$ and $X_3$ of FIG. 3) of the group $X_{G1}$. Accordingly, negative-polarity wall charges are formed in the discharge space around the first Y electrode line $Y_1$, and positive-polarity wall charges are formed in the discharge space around the first X electrode line $X_1$. When the scan pulses $P_{SY1}$ and $P_{SX1}$ are terminated, a voltage due to the wall charges is applied between the first pair of X and Y electrode lines $X_1$ and $Y_1$. Thus, a discharge is performed between the pair of X and Y electrode lines $X_1$ and $Y_1$ by the positive-polarity display pulse $P_{DX1}$ applied to the first X group $X_{G1}$, so that positive-polarity wall charges are formed in the discharge space around the first Y electrode line $Y_1$ and negative-polarity wall charges are formed in the discharge space around the first X electrode line $X_1$.

Next, the data signals $S_{AR1 \ldots ABm}$ corresponding to the first pair of X and Y electrode lines $X_1$ and $Y_1$ are applied to the address electrode lines $A_{R1}$, $A_{G1}$, $A_{B1}$, . . . $A_{Rm}$, $A_{Gm}$, $A_{Bm}$ to erase the wall charges formed at unselected discharges. In other words, as a positive-polarity data pulse $P_{A1}$ is applied to the address electrode lines of the unselected discharge cells, the wall charges formed at the unselected discharge cells are erased. While the data pulse $P_{A1}$ of an address signal is applied, bias pulses $P_{BX1}$ and $P_{BY1}$ having the opposite polarity as the data pulse $P_{A1}$ of the address signal are applied to the X and Y electrode lines of X and Y electrode groups $X_{G1}$ and $Y_{G1}$ to which the first pair of X and Y electrode lines $X_1$ and $Y_1$ belong. Accordingly, additional wall charges of unselected discharge cells are erased. However, while not shown in FIGS. 8A through 8G, it is understood that a bias pulse need not be applied in all instances.

Next, until the first unit driving period ranging from 0H to 1H is terminated, the display pulses $P_{DY1}$, $P_{DX2}$, $P_{DY2}$, $P_{DX3}$, $P_{DY3}$, $P_{DX4}$, . . . are alternately applied to the X and Y electrode lines of the pair of X and Y groups $X_{G1}$ and $Y_{G1}$ so that a display discharge occurs at discharge cells where wall charges are formed. Here, scan and address periods for a pair of X and Y electrode lines of a second $SF_2$ are performed during the time between first and second Y display pulses $P_{DY1}$ and $P_{DY2}$ (not shown). Next, scan and address periods for a pair of X and Y electrode lines of a third $SF_3$ are performed during the time between second and third Y display pulses $P_{DY2}$ and $P_{DY3}$ (not shown). Thus, scan and address periods for a pair of X and Y electrode lines of an eighth subfield ($SF_8$ of FIG. 4) are performed immediately before application of an eighth Y display pulse $P_{DY8}$ (not shown).

Next, scan and address periods for the second pair of X and Y electrode lines $X_2$ and $Y_2$ of the first subfield $SF_1$ are performed at the starting time of a second unit driving period after 1H. Also, scan and address periods for a first pair of X and Y electrode lines $X_1$ and $Y_1$ of the second $SF_2$ are performed during the time between ninth and tenth Y display pulses $P_{DY9}$ and $P_{DY10}$. Next, scan and address periods for a pair of X and Y electrode lines of a third $SF_3$ are performed during the time between tenth and eleventh Y display pulses $P_{DY10}$ and $P_{DY11}$ (not shown). Likewise, scan and address periods for a pair of X and Y electrode lines of a fourth $SF_4$ are performed during the time between eleventh and twelfth Y display pulses $P_{DY11}$ and $P_{DY12}$ (not shown).

Figures 9A, 9B, 9C:
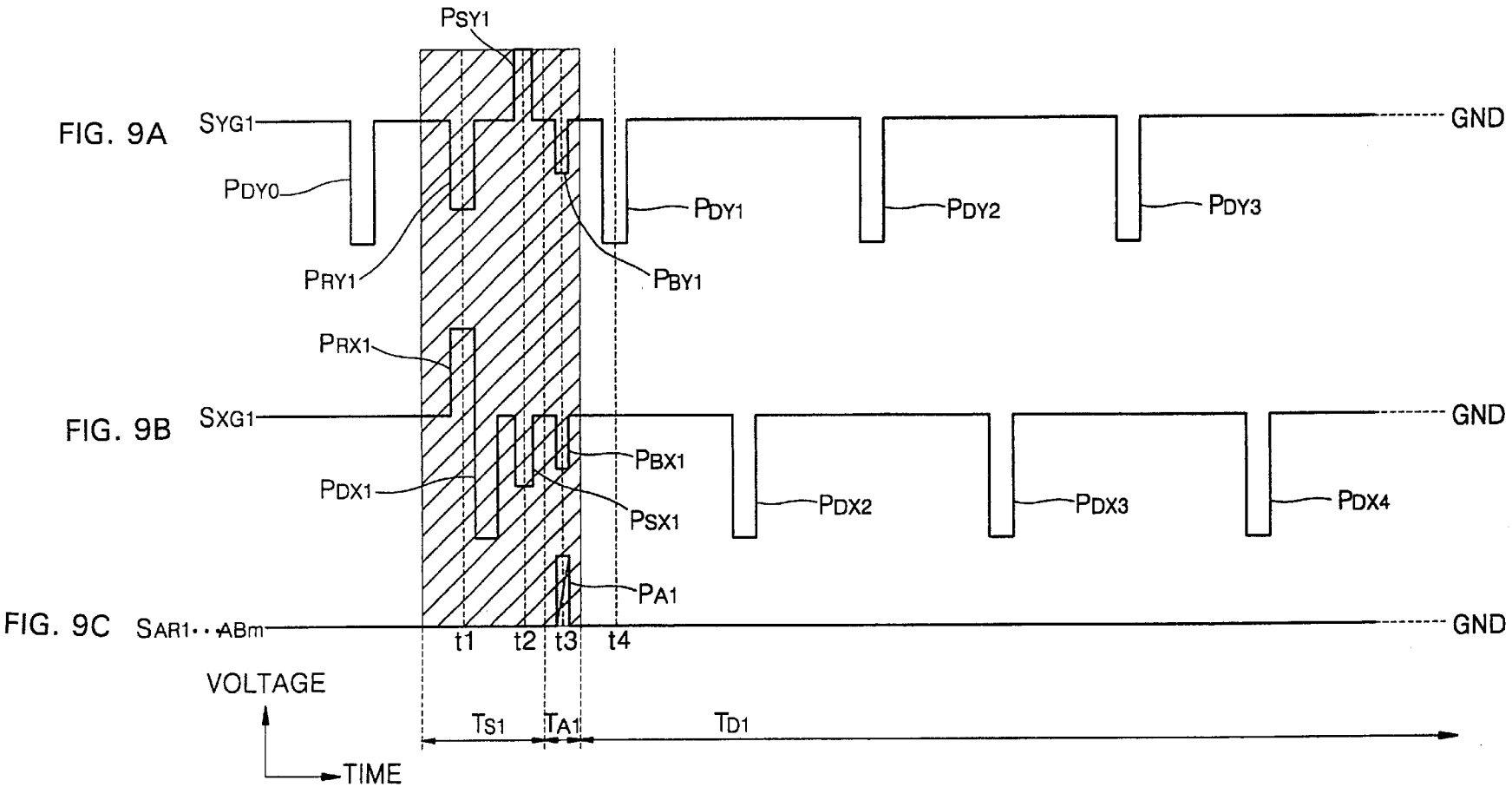
FIGS. 9A through 9C are waveform diagrams of driving signals applied to the pairs of X and Y electrode groups $X_{G1}$ and $Y_{G1}$ to which the first pair of X and Y electrode lines $X_1$ and $Y_1$ belong according to a further embodiment of the present invention.
Figures 10A, 10B, 10C, 10D, 10E, 10F, 10G:
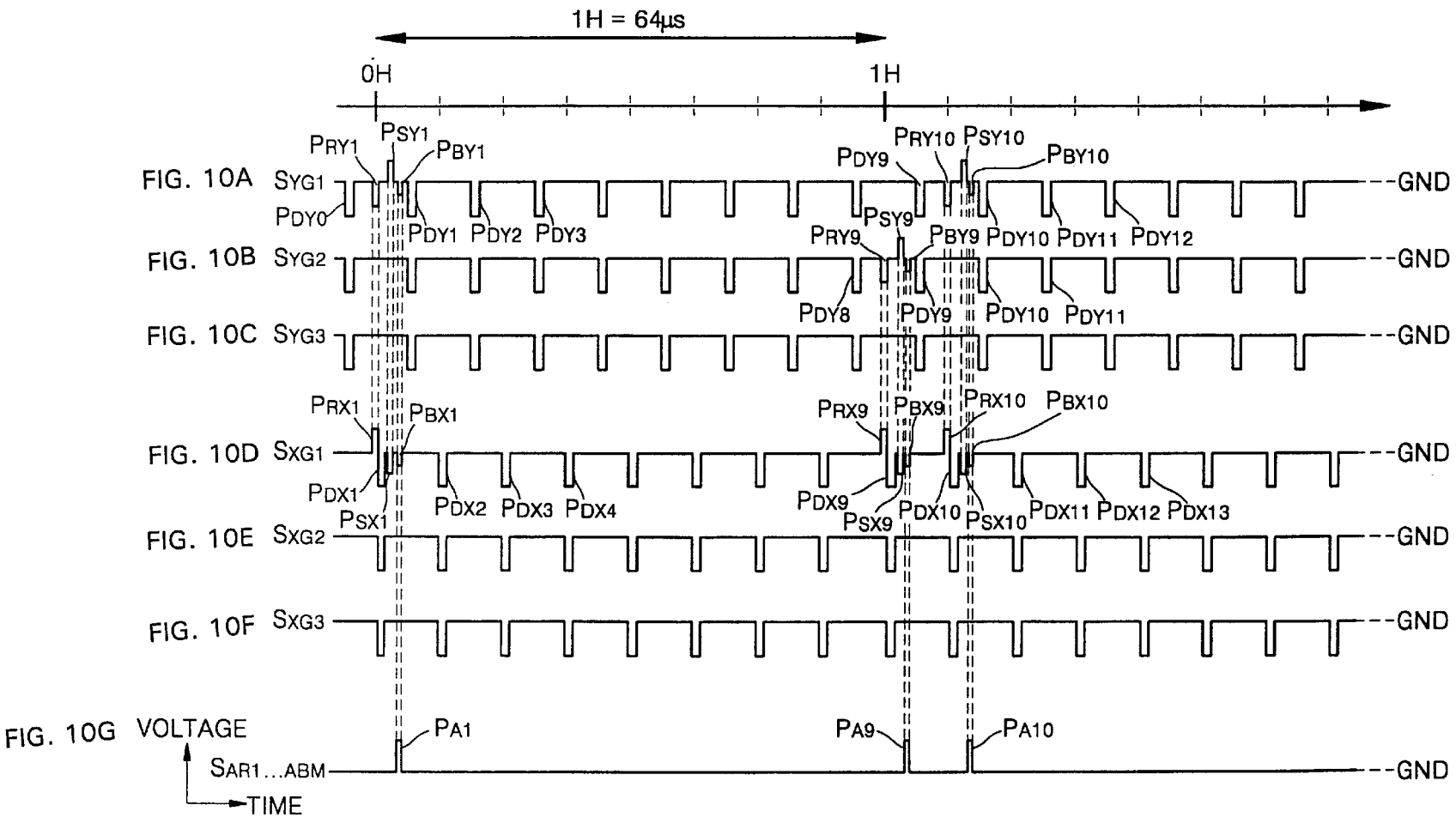
FIGS. 10A through 10G are timing diagrams illustrating the procedure for driving the first pair of X and Y electrode lines $X_1$ and $Y_1$ of a first subfield, a second pair of X and Y electrode lines $X_2$ and $Y_2$ of the first subfield and the first pair of X and Y electrode lines $X_1$ and $Y_1$ of a second subfield by the driving waveforms shown in FIGS. 9A through 9C.
Figure 11:
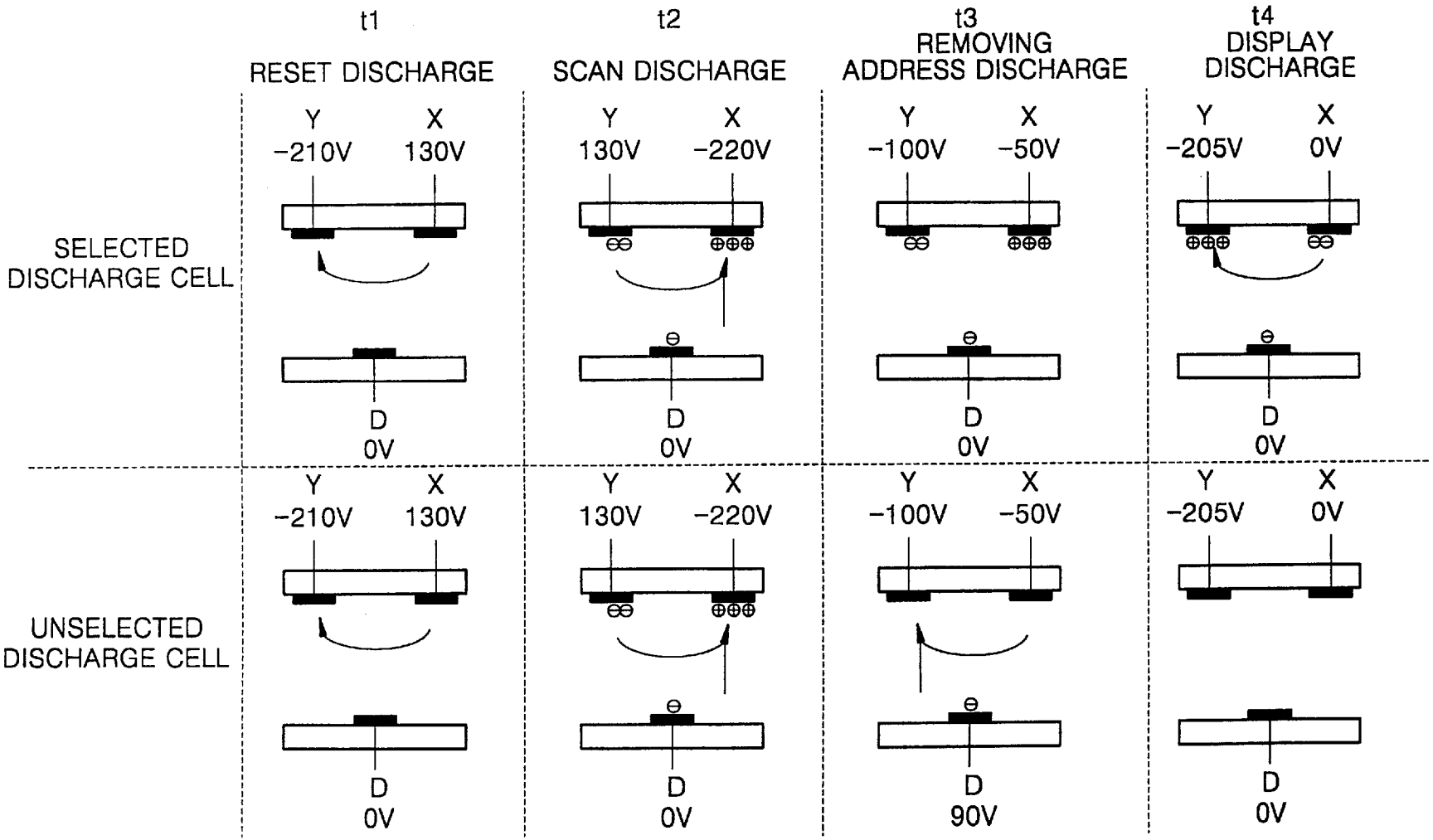
FIG. 11 is a diagram illustrating the state of discharge cells at various timing points shown in FIGS. 9A through 9C.
Figures 12A, 12B, 12C, 12D, 12E, 12F, 12G:
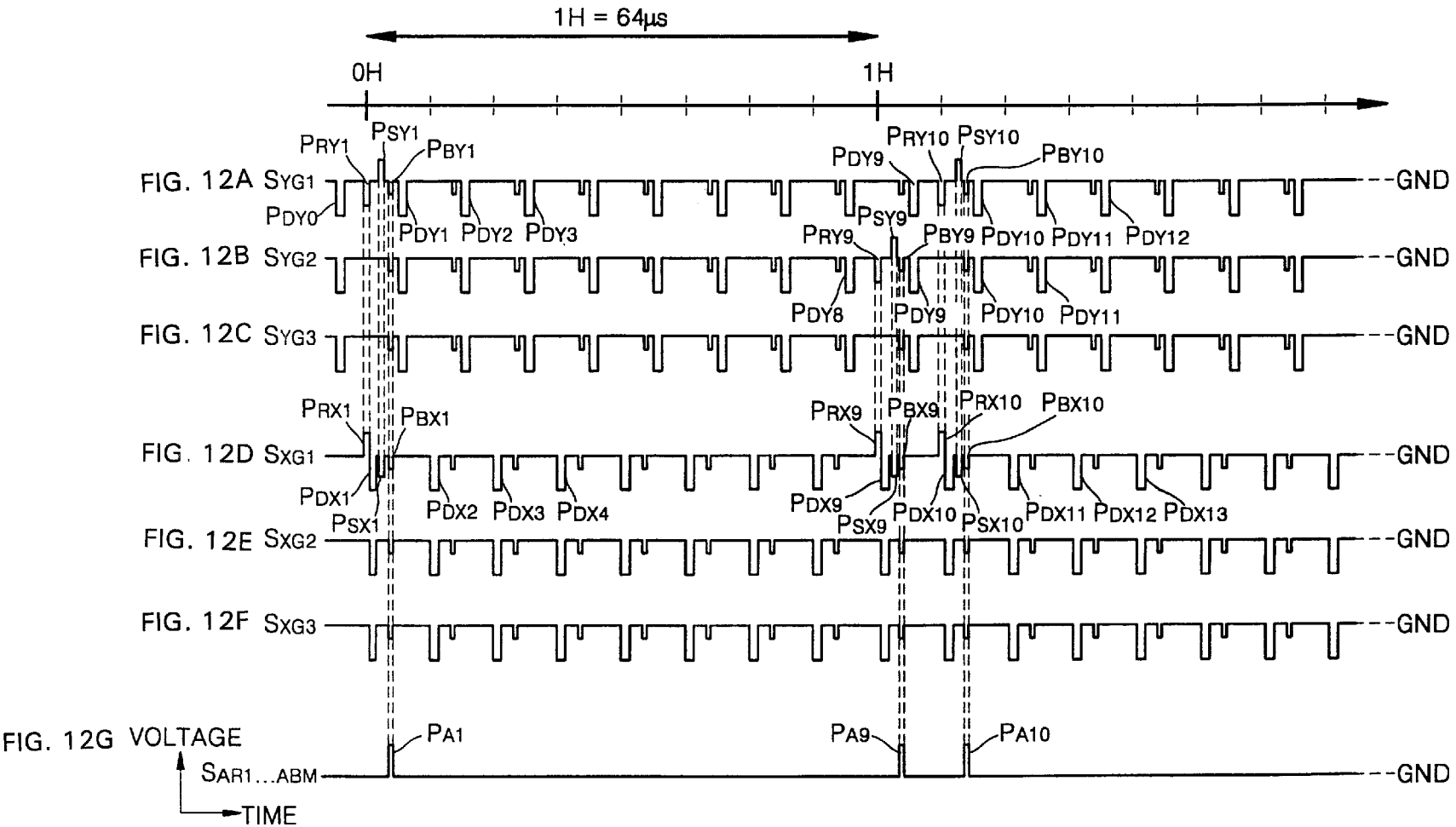
FIGS. 12A through 12G are timing diagrams illustrating the procedure for driving the first pair of X and Y electrode lines $X_1$ and $Y_1$ of the first subfield, a second pair of X and Y electrode lines $X_2$ and $Y_2$ of the first subfield and the first pair of X and Y electrode lines $X_1$ and $Y_1$ of a second subfield according to a still further embodiment of the present invention.
Figures 13A, 13B, 13C, 13D, 13E, 13F, 13G:
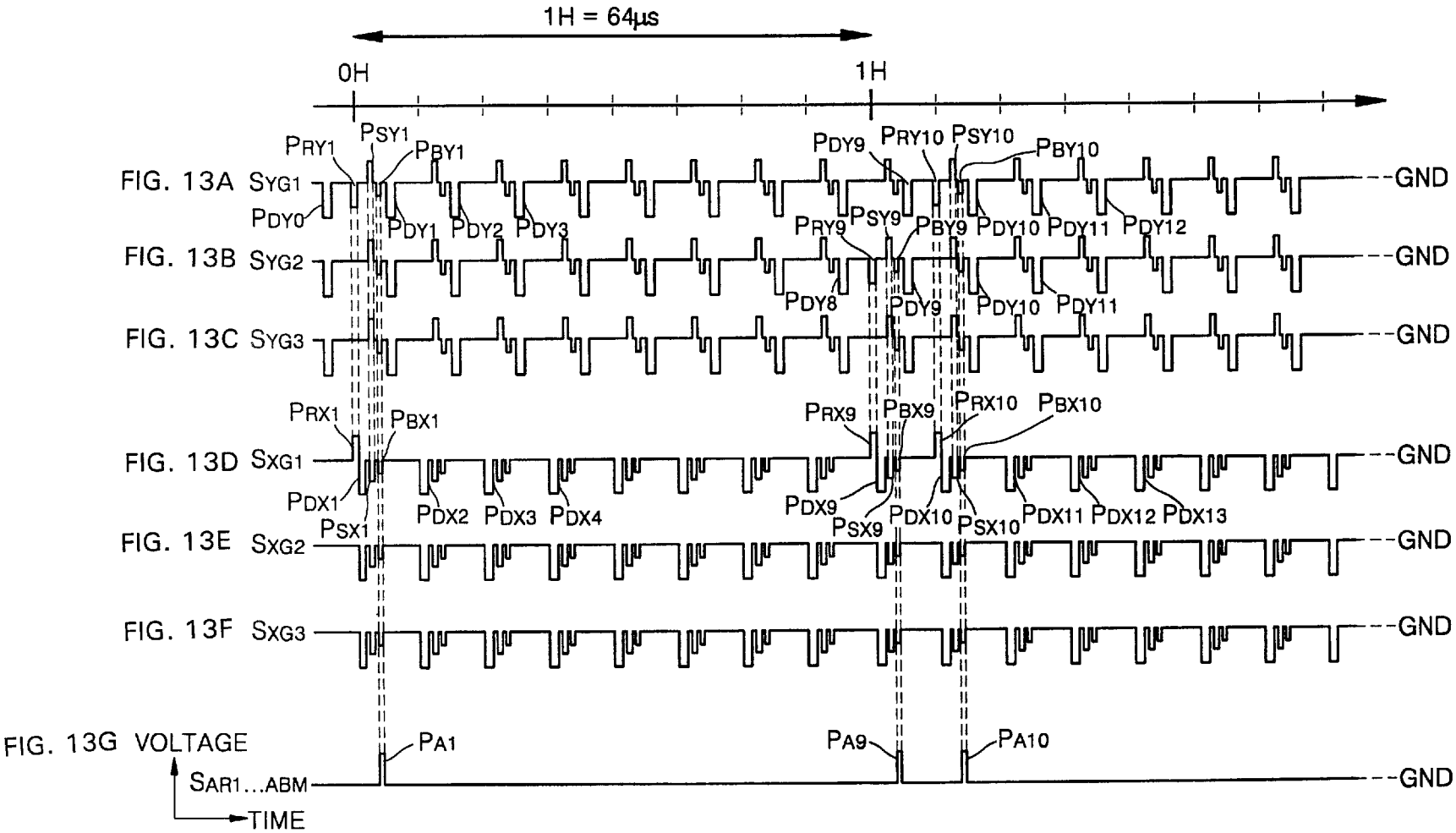
FIGS. 13A through 13G are timing diagrams illustrating the procedure for driving a first pair of X and Y electrode lines $X_1$ and $Y_1$ of a first subfield, a second pair of X and Y electrode lines $X_2$ and $Y_2$ of the first subfield and the first pair of X and Y electrode lines $X_1$ and $Y_1$ of a second subfield, according to a yet further embodiment of the present invention.
Figures 14A, 14B, 14C, 14D, 14E, 14F, 14G:
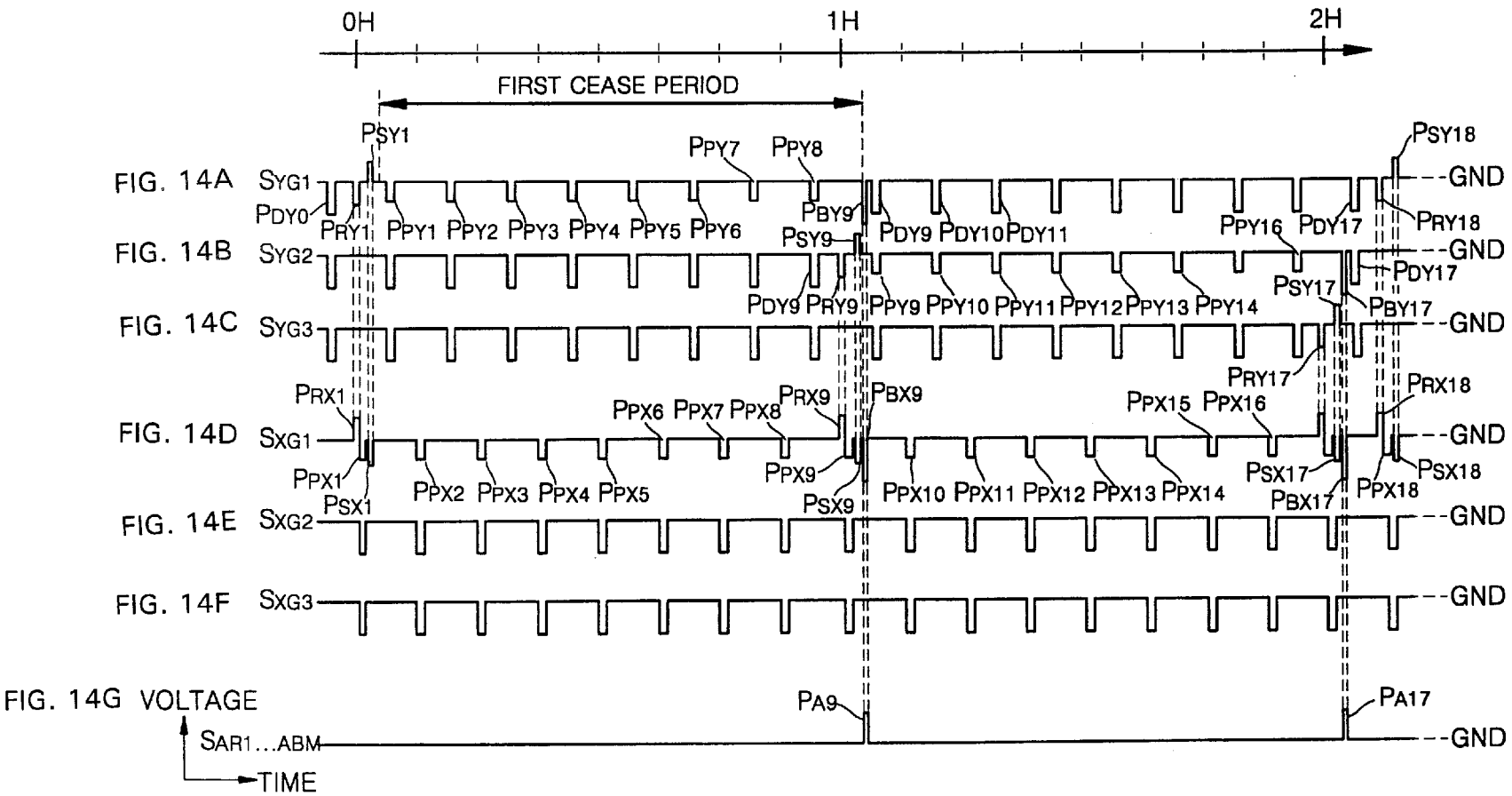
FIGS. 14A through 14G are timing diagrams illustrating the procedure for driving a first pair of X and Y electrode lines $X_1$ and $Y_1$ of a first subfield and a second pair of X and Y electrode lines $X_2$ and $Y_2$ of the first subfield according to still another embodiment of the present invention.
Figures 15A, 15B, 15C, 15D, 15E, 15F, 15G:
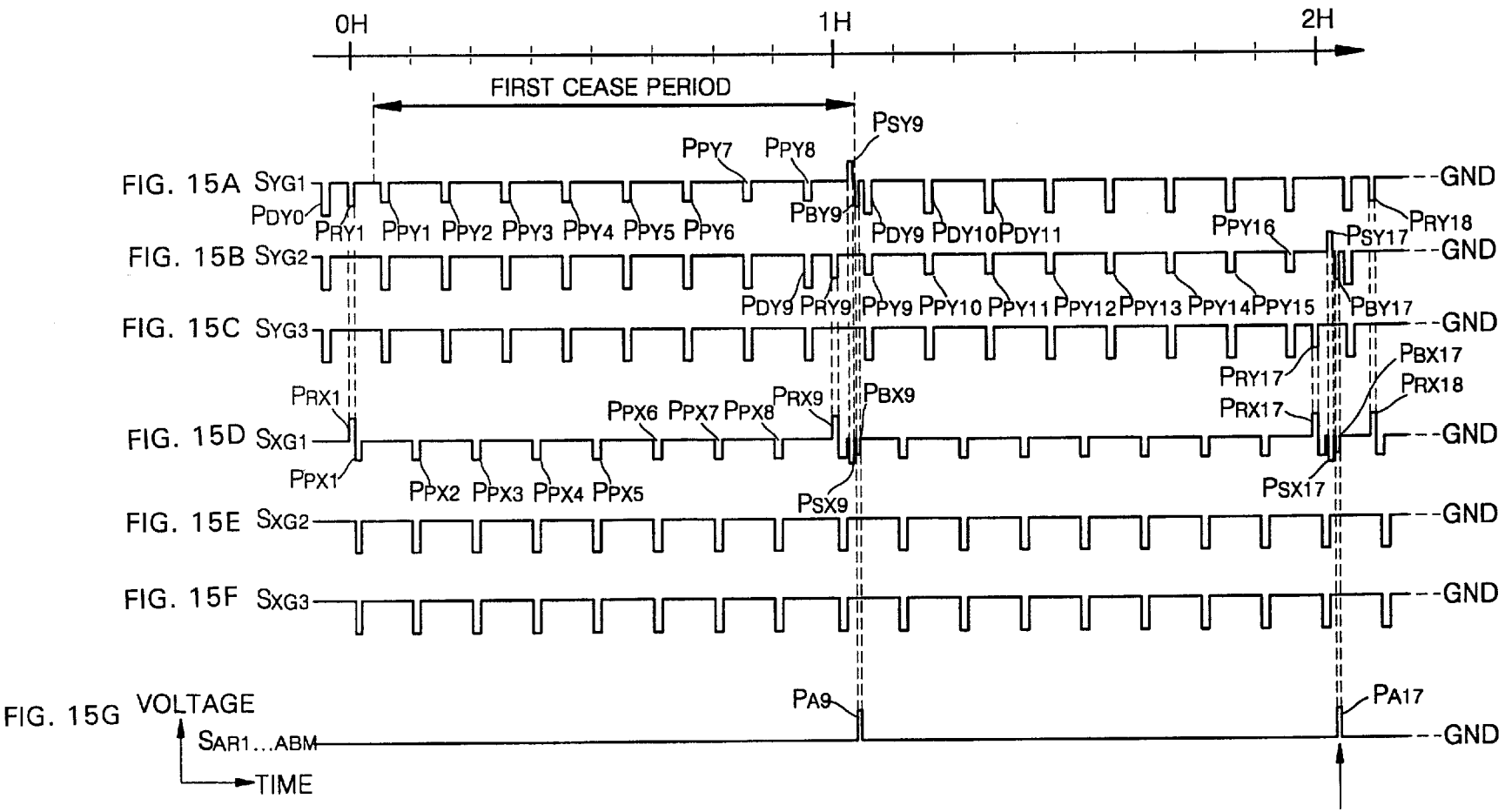
FIGS. 15A through 15G are timing diagrams illustrating the procedure for driving a first pair of X and Y electrode lines $X_1$ and $Y_1$ of a first subfield and a second pair of X and Y electrode lines $X_2$ and $Y_2$ of the first subfield according to yet another embodiment of the present invention.
Figures 16A, 16B, 16C, 16D, 16E, 16F, 16G:
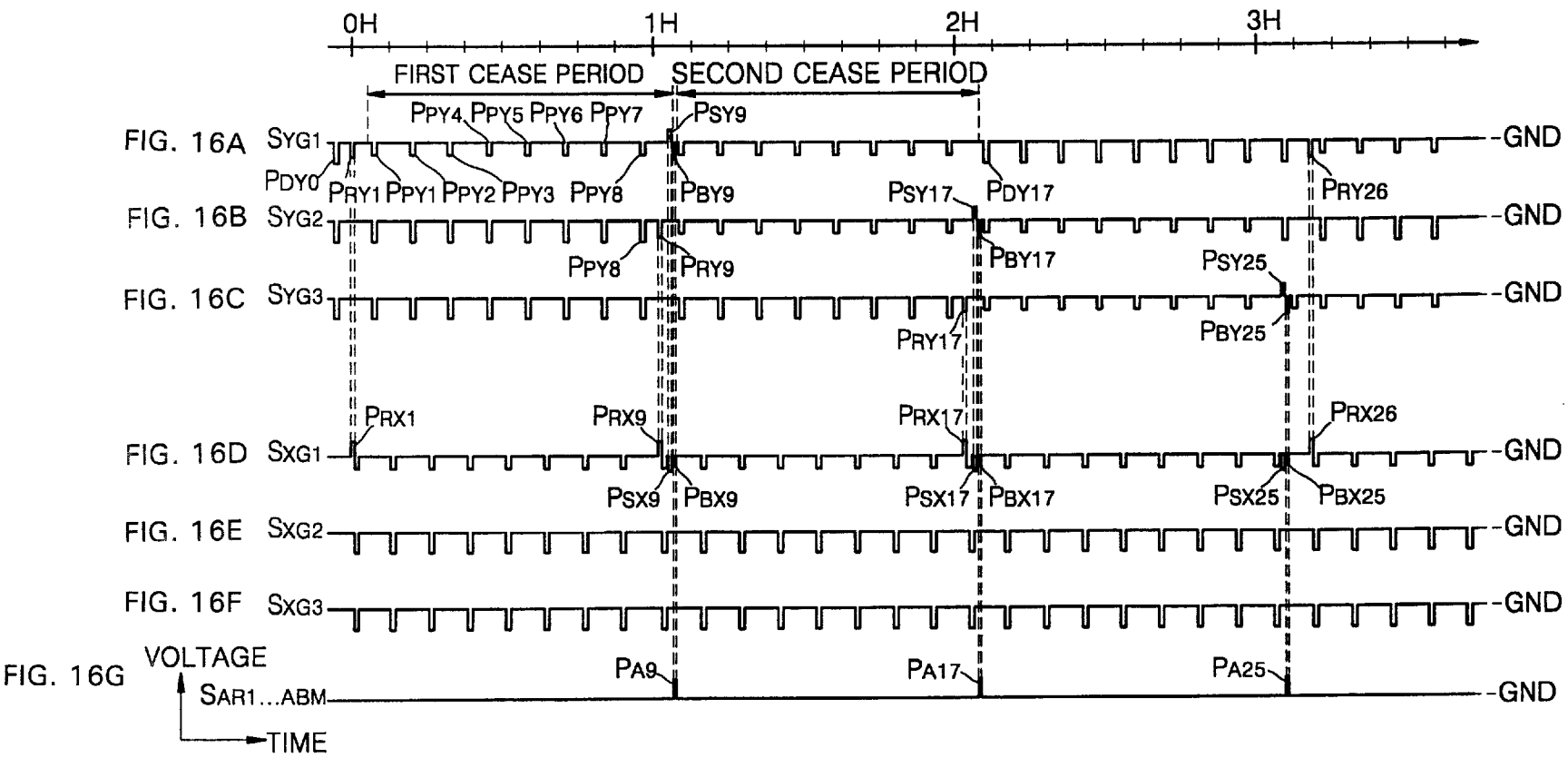
FIGS. 16A through 16G are timing diagrams illustrating the procedure for driving a first pair of X and Y electrode lines $X_1$ and $Y_1$ of a first subfield, a second pair of X and Y electrode lines $X_2$ and $Y_2$ of the first subfield and a third pair of X and Y electrode lines $X_3$ and $Y_3$ of the first subfield, according to a still yet further embodiment of the present invention.

FIGS. 9A through 9C are waveform diagrams of driving signals applied to the first pair of X and Y electrode groups $X_{G1}$ and $Y_{G1}$ to which a first pair of X and Y electrode lines $X_1$ and $Y_1$ shown in FIG. 3 belong according to another embodiment of the present invention. FIGS. 10A through 10G are timing diagrams illustrating the procedure of driving the first pair of X and Y electrode lines $X_1$ and $Y_1$ of a first subfield, a second pair of X and Y electrode lines $X_2$ and $Y_2$ of the first subfield, and the first pair of X and Y electrode lines $X_1$ and $Y_1$ of a second subfield by the driving waveforms shown in FIGS. 9A through 9C. FIG. 11 is a diagram illustrating the state of discharge cells at various timing points shown in FIGS. 9A through 9C. In FIGS. 9, 10 and 11, the same symbols as those of FIGS. 7 and 8 denote the same functional elements. In FIG. 11, X denotes an X electrode line of a discharge cell, Y denotes a Y electrode line of a discharge cell, and D denotes an address electrode line of a discharge cell.

Referring to FIGS. 9, 10 and 11, scan and address periods for the first pair of X and Y electrode lines $X_1$ and $Y_1$ of the first subfield ($SF_1$ of FIG. 4) are performed at the starting time of a first unit driving period ranging from 0H to 1H, which will now be described in detail. During a scan period $T_{S1}$ for the first pair of X and Y electrode lines $X_1$ and $Y_1$, a negative-polarity Y reset pulse $P_{RY1}$ is applied to the Y electrode lines ($Y_1$, $Y_4$ and $Y_7$ of FIG. 3) of the pair of X and Y groups $X_{G1}$ and $Y_{G1}$, and a positive-polarity X reset pulse $P_{RX1}$ is applied to the X electrode lines ($X_1$, $X_2$ and $X_3$ of FIG. 3) of the group $X_{G1}$. Accordingly, the wall charges existing in the discharge space around the first pair of X and Y electrode line $X_1$ and $Y_1$ are erased (at the timing point t1). The above-described erasing operation is performed for the purpose of increasing the accuracy of scan and address driving operations (at the subsequent timing points t2 and t3).

Next, a positive-polarity Y scan pulse $P_{SY1}$ is applied to the Y electrode lines $Y_1$, $Y_4$ and $Y_7$ of the pair of X and Y groups $X_{G1}$, and $Y_{G1}$, and a negative-polarity X scan pulse $P_{SX1}$ is applied to the X electrode lines $X_1$, $X_2$ and $X_3$ of the group $X_{G1}$. Accordingly, negative-polarity wall charges are formed in the discharge space around the first Y electrode line $Y_1$, and positive-polarity wall charges are formed in the discharge space around the first X electrode line $X_1$ (at the timing point t2). At the time when the scan pulses $P_{SY1}$ and $P_{SX1}$ are terminated, a voltage due to the wall charges is applied between the first pair of X and Y electrode lines $X_1$ and $Y_1$.

During a subsequent address period $T_{A1}$, data signals $S_{AR1 \ldots ABm}$ corresponding to the first pair of X and Y electrode lines $X_1$ and $Y_1$ are applied to the address electrode lines $A_{R1}$, $A_{G1}$, $A_{B1}$, . . . $A_{Rm}$, $A_{Gm}$, $A_{Bm}$ to erase the wall charges formed at the unselected discharges. In other words, as a positive-polarity data pulse $P_{A1}$ is applied to the address electrode lines of the unselected discharge cells, the wall charges formed at unselected discharge cells are erased. While the data pulse $P_{A1}$ of an address signal is applied, bias pulses $P_{BX1}$ and $P_{BY1}$ having the opposite polarity with the data pulse $P_{A1}$ of the address signal are applied to the electrode lines of X and Y electrode groups $X_{G1}$ and $Y_{G1}$ to which the first pair of X and Y electrode lines $X_1$ and $Y_1$ belong. Accordingly, additional wall charges of unselected discharge cells are erased (at the timing point t3). However, it is understood that the bias pulse need not be used in all applications.

Next, until the first unit driving period ranging from 0H to 1H is terminated ($T_{D1}$), negative-polarity display pulses $P_{DY1}$, $P_{DX2}$, $P_{DY2}$, $P_{DX3}$, $P_{DY3}$, $P_{DX4}$, . . . are alternately applied to the electrode lines of the pair of X and Y groups $X_{G1}$ and $Y_{G1}$ to which the first pair of X and Y electrode lines $X_1$ and $Y_1$ belong, so that a display discharge occurs at discharge cells where wall charges are formed (at the timing point t4). Here, scan and address periods for a pair of X and Y electrode lines of a second $SF_2$ are performed during the time between first and second Y display pulses $P_{DY1}$ and $P_{DY2}$ (not shown). Next, scan and address periods for a pair of X and Y electrode lines of a third $SF_3$ are performed during the time between second and third Y display pulses $P_{DY2}$ and $P_{DY3}$ (not shown). Thus, scan and address periods for a pair of X and Y electrode lines of an eighth subfield ($SF_8$ of FIG. 4) are performed immediately before application of an eighth Y display pulse $P_{DY8}$ (not shown).

Next, scan and address periods for the second pair of X and Y electrode lines $X_2$ and $Y_2$ of the first subfield $SF_1$ are performed at the starting time of a second unit driving period after 1H. Also, scan and address periods for the first pair of X and Y electrode lines $X_1$ and $Y_1$ of the second $SF_2$ are performed during the time between ninth and tenth Y display pulses $P_{DY9}$ and $P_{DY10}$. Next, scan and address periods for a pair of X and Y electrode lines of a third $SF_3$ are performed during the time between tenth and eleventh Y display pulses $P_{DY10}$ and $P_{DY11}$ (not shown). Likewise, scan and address periods for a pair of X and Y electrode lines of a fourth $SF_4$ are performed during the time between eleventh and twelfth Y display pulses $P_{DY11}$ and $P_{DY12}$ (not shown).

FIGS. 12A through 12G are timing diagrams illustrating the procedure of driving the first pair of X and Y electrode lines $X_1$ and $Y_1$ of a first subfield, the second pair of X and Y electrode lines $X_2$ and $Y_2$ of the first subfield, and the first pair of X and Y electrode lines $X_1$ and $Y_1$ of the second subfield according to another embodiment of the present invention. In FIGS. 12A through 12G, the same symbols as those in FIGS. 10A through 10G denote the same functional elements. The driving waveforms shown in FIGS. 12A through 12G further include periodically appearing bias pulses $P_{BY1}$, $P_{BX1}$ . . . , $P_{BY9}$, $P_{BX9}$, $P_{BY10}$, $P_{BX10}$, . . . in addition to those shown in FIGS. 10A through 10G. In other words, before the respective display pulses $P_{DY0}$, $P_{DX1}$, . . . $P_{DY12}$, $P_{DX13}$ . . . are applied to the electrode lines of all X and Y groups ($Y_{G1}, \ldots, Y_{Gn/3}$, $X_{G1}, \ldots, X_{Gn/3}$ of FIG. 3), bias pulses having the same polarities with those of bias pulses $P_{BY1}$, $P_{BX1}$, $P_{BY9}$, $P_{BX9}$, $P_{BY10}$ and $P_{BX10}$ applied in the address operation. Therefore, driving errors due to a time difference can be reduced.

FIGS. 13A through 13G are timing diagrams illustrating the procedure of driving the first pair of X and Y electrode lines $X_1$ and $Y_1$ of the first subfield, the second pair of X and Y electrode lines $X_2$ and $Y_2$ of the first subfield and the first pair of X and Y electrode lines $X_1$ and $Y_1$ of a second subfield according to another embodiment of the present invention. In FIGS. 13A through 13G, the same symbols as those in FIGS. 12A through 12G denote the same functional elements. The driving waveforms shown in FIGS. 13A through 13G further include periodically appearing auxiliary pulses $P_{SY1}, \ldots, P_{SX1}, \ldots$ in addition to those shown in FIGS. 12A through 12G. In other words, before the respective display pulses $P_{DY0}$, $P_{DX1}, \ldots P_{DY12}$, $P_{DX13} \ldots$ are applied to the electrode lines of all X and Y groups ($Y_{G1}, \ldots, Y_{Gn/3}$, $X_{G1}, \ldots, X_{Gn/3}$ of FIG. 3), bias pulses $P_{BY1}, P_{BX1}, \ldots, P_{BY9}, P_{BX9}, \ldots, P_{BY10}, P_{BX10}, \ldots$ are applied. Also, before these bias pulses are applied, auxiliary pulses having the same polarities with the scan pulses $P_{SY1}$, $P_{SX1}$, $P_{SY9}$, $P_{SX9}$, $P_{SY10}$ and $P_{SX10}$ are applied in the address step. Therefore, driving errors due to a time difference can be further reduced.

FIGS. 14A through 14G are timing diagrams illustrating the procedure of driving the first pair of X and Y electrode lines $X_1$ and $Y_1$ of the first subfield and the second pair of X and Y electrode lines $X_2$ and $Y_2$ of the first subfield according to a further embodiment of the present invention. In FIGS. 14A through 14G, the same symbols as those in FIGS. 10A through 10G denote the same functional elements. The driving method shown in FIGS. 14A through 14G further includes cease periods between each of the respective scan and address steps as compared to the driving method shown in FIGS. 10A through 10G.

Referring to FIGS. 14A through 14G, after scan pulses $P_{SX1}$ and $P_{SY1}$ are applied to the first pair of X and Y groups ($X_{G1}$ and $Y_{G1}$ of FIG. 3) and before the data pulse $P_{A9}$ is applied, there is a first cease period corresponding to the time for the first unit driving time ranging from 0H to 1H. During the first cease period, in order to appropriately erase space charges due to a scan discharge between the first pair of X and Y electrode lines ($X_1$ and $Y_1$ of FIG. 3), cease pulses $P_{PY1}$, $P_{PX1}, \ldots P_{PY8}$ are applied to the $X_1$ and $Y_1$ electrode lines of the first pair of X and Y groups $X_{G1}$ and $Y_{G1}$. Accordingly, excess space charges do not form in the discharge space around the first pair of X and Y electrode lines $X_1$ and $Y_1$, thereby attaining a stable state of the space charges.

During the time between first and second Y cease pulses $P_{PY1}$ and $P_{PY2}$, a scan discharge occurs at a pair of X and Y electrode lines of a second subfield. Thus, during the time between seventh and eighth Y cease pulses $P_{PY7}$ and $P_{PY8}$, a scan discharge occurs at a pair of X and Y electrode lines of an eighth subfield.

At the starting time of a second unit driving period ranging from 1H to 2H, after scan pulses $P_{SX9}$ and $P_{SY9}$ are applied to the second pair of X and Y groups ($X_{G2}$ and $Y_{G2}$ of FIG. 3) and before a data pulse $P_{A17}$ is applied, there is a ninth cease period corresponding to the time for the second unit driving time ranging from 0H to 1H. During the time between ninth and tenth Y cease pulses $P_{PY9}$ and $P_{PY10}$, a scan discharge occurs at a pair of X and Y electrode lines of a second subfield. Thus, during the time between fifteenth and sixteenth Y cease pulses $P_{PY15}$ and $P_{PY16}$, a scan discharge occurs at a pair of X and Y electrode lines of an eighth subfield.

At the starting time of a third unit driving period ranging from 2H to 3H, a scan discharge occurs at a third pair of X and Y electrode lines $X_3$ and $Y_3$ of the first subfield (see $P_{SX17}$ and $P_{SY17}$). Also, there is a seventeenth cease period corresponding to the time for the third unit driving period ranging from 2H to 3H before a data pulse (not shown) is applied. Immediately before and after an eighth X cease pulse $P_{PX18}$, the first pair of X and Y electrode lines $X_1$ and $Y_1$ of the second subfield are scanned (see $P_{RX18}$, $P_{RY18}$, $P_{SX18}$ and $P_{SY18}$).

FIGS. 15A through 15G are timing diagrams illustrating the procedure of driving the first pair of X and Y electrode lines $X_1$ and $Y_1$ of the first subfield and the second pair of X and Y electrode lines $X_2$ and $Y_2$ of the first subfield according to another embodiment of the present invention. In FIGS. 15A through 15G, the same symbols as those in FIGS. 14A through 14G denote the same functional elements.

Referring to FIGS. 15A through 15G, after reset pulses $P_{RX1}$ and $P_{RY1}$ are applied to the first pair of X and Y groups ($X_{G1}$ and $Y_{G1}$ of FIG. 3) and before scan pulses $P_{SX9}$ and $P_{SY9}$ are applied, there is a first cease period corresponding to the time for a unit driving time ranging from 0H to 1H. During the first cease period, in order to appropriately erase space charges due to a reset discharge between the first pair of X and Y electrode lines ($X_1$ and $Y_1$ of FIG. 3), cease pulses $P_{PY1}$, $P_{PX1}, \ldots P_{PY8}$ are applied to electrode lines of the first pair of X and Y groups $X_{G1}$ and $Y_{G1}$. Accordingly, excess space charges do not form in the discharge space around the first pair of X and Y electrode lines $X_1$ and $Y_1$, thereby attaining a stable state of the space charges.

During the time between first and second Y cease pulses $P_{PY1}$ and $P_{PY2}$, a reset discharge occurs at a pair of X and Y electrode lines of a second subfield (not shown). Thus, during the time between seventh and eighth Y cease pulses $P_{PY7}$ and $P_{PY8}$, a reset discharge occurs at a pair of X and Y electrode lines of an eighth subfield (not shown).

At the starting time of a second unit driving period ranging from 1H to 2H, after reset pulses $P_{RX9}$ and $P_{RY9}$ are applied to the second pair of X and Y groups ($X_{G1}$ and $Y_{G2}$ of FIG. 3) and before scan pulses $P_{SX17}$ and $P_{SY17}$ are applied, there is a ninth cease period corresponding to the time for the second unit driving time ranging from 0H to 1H. During the time between ninth and tenth Y cease pulses $P_{PY9}$ and $P_{PY10}$, a reset discharge occurs at a pair of X and Y electrode lines of a second subfield (not shown). Thus, during the time between fifteenth and sixteenth Y cease pulses $P_{PY15}$ and $P_{PY16}$, a reset discharge occurs at a pair of X and Y electrode lines of an eighth subfield (not shown).

At the starting time of a third unit driving period ranging from 2H to 3H, a reset discharge occurs at a third pair of X and Y electrode lines $X_3$ and $Y_3$ of the first subfield (see $P_{RX17}$ and $P_{RY17}$). Also, there is a seventeenth cease period corresponding to the time for the third unit driving period ranging from 2H to 3H before a scan pulse (not shown) is applied. After the reset discharge (see $P_{RX17}$ and $P_{RY17}$), a reset discharge occurs at the first pair of X and Y electrode lines $X_1$ and $Y_1$ of the second subfield (see $P_{RX18}$ and $P_{RY18}$).

FIGS. 16A through 16G are timing diagrams illustrating the procedure of driving the first pair of X and Y electrode lines $X_1$ and $Y_1$ of the first subfield, the second pair of X and Y electrode lines $X_2$ and $Y_2$ of the first subfield and the third pair of X and Y electrode lines $X_3$ and $Y_3$ of the first subfield according to another embodiment of the present invention. In FIGS. 16A through 16G, the same reference marks as those in FIGS. 15A through 15G denote the same functional elements.

Referring to FIGS. 16A through 16G, after reset pulses $P_{RX1}$ and $P_{RY1}$ are applied to the first pair of X and Y groups ($X_{G1}$ and $Y_{G1}$ of FIG. 3) and before scan pulses $P_{SX9}$ and $P_{SY9}$ are applied, there is a first cease period corresponding to the time for a unit driving time ranging from 0H to 1H. Also, after a data pulse $P_{A9}$ is applied to address electrode lines which are not to be displayed and before display pulses $P_{DX17}$, . . . are applied, there is a second cease period corresponding to the time for a unit driving time ranging from 1H to 2H. During the first and second cease periods, in order to appropriately erase space charges due to a reset or address discharge between the first pair of X and Y electrode lines ($X_1$ and $Y_1$ of FIG. 3), cease pulses $P_{PY1}$, . . . are applied to the X and Y electrode lines of the first pair of X and Y groups $X_{G1}$ and $Y_{G1}$ to which the first pair of X and Y electrode lines $X_1$ and $Y_1$ belong. Accordingly, excess space charges do not form in the discharge space around the first pair of X and Y electrode lines $X_1$ and $Y_1$, thereby attaining a stable state of the space charges.

During the time between first and second Y cease pulses $P_{PY1}$ and $P_{PY2}$, a reset discharge occurs at a pair of X and Y electrode lines of a second subfield (not shown). Thus, during the time between seventh and eighth Y cease pulses $P_{PY7}$ and $P_{PY8}$, a reset discharge occurs at a pair of X and Y electrode lines of an eighth subfield (not shown).

During a subsequent second unit driving period ranging from 1H to 2H, at the time between eighth and ninth Y cease pulses $P_{PY8}$ and $P_{PY9}$, an address discharge occurs at the first pair of X and Y electrode lines $X_1$ and $Y_1$ of the first subfield (see $P_{BX9}$, $P_{BY9}$ and $P_{A9}$). Thus, during the time between fifteenth and sixteenth Y cease pulses $P_{PY15}$ and $P_{PY16}$, an address discharge occurs at a pair of X and Y electrode lines of an eighth subfield (not shown).

During the time between eighth and ninth Y cease pulses $P_{PY8}$ and $P_{PY9}$, after reset pulses $P_{RX9}$ and $P_{RY9}$ are applied to the second pair of X and Y groups $X_{G1}$ and $Y_{G2}$ and before scan pulses $P_{SX17}$ and $P_{SY17}$ are applied, there is a second cease period corresponding to the time for a unit driving time ranging from 1H to 2H. Also, after a data pulse $P_{A17}$ is applied to address electrode lines which are not to be displayed and before display pulses are applied, there is another cease period corresponding to the time for a unit driving time.

During the time between ninth and tenth Y cease pulses, a reset discharge occurs at a pair of X and Y electrode lines of a second subfield (not shown). Thus, during the time between fifteenth and sixteenth Y cease pulses, a reset discharge occurs at a pair of X and Y electrode lines of an eighth subfield (not shown). During a subsequent third unit driving period ranging from 2H to 3H, at the time between sixteenth and seventeenth Y cease pulses, an address discharge occurs at a second pair of X and Y electrode lines of the first subfield (see $P_{BX17}$, $P_{BY17}$ and $P_{A17}$). Thus, during the time between twenty-third and twenty-fourth Y cease pulses, an address discharge occurs at a pair of X and Y electrode lines of an eighth subfield (not shown).

Likewise, during the time between the sixteenth and seventeenth Y cease pulses, after reset pulses $P_{RX17}$ and $P_{RY17}$ are applied to a third pair of X and Y groups $X_{G1}$ and $Y_{G3}$ and before scan pulses $P_{SX25}$ and $P_{SY25}$ are applied, there is a first cease period corresponding to the time for a unit driving time ranging from 2H to 3H. Also, after a data pulse $P_{A25}$ is applied to address electrode lines which are not to be displayed and before display pulses are applied, there is a second cease period corresponding to the time for a unit driving time.

During the time between seventeenth and eighteenth Y cease pulses, a reset discharge occurs at a pair of X and Y electrode lines of a second subfield (not shown). Thus, during the time between twenty-third and twenty-fourth Y cease pulses, a reset discharge occurs at a pair of X and Y electrode lines of an eighth subfield (not shown). During a subsequent fourth unit driving period ranging from 3H to 4H, at the time between twenty-fourth and twenty-fifth Y cease pulses, an address discharge occurs at a third pair of X and Y electrode lines $X_3$ and $Y_3$ of the first subfield (see $P_{BX25}$, $P_{BY25}$ and $P_{A25}$). During the time between twenty-fourth and twenty-fifth Y cease pulses, a reset discharge occurs at the first pair of X and Y electrode lines $X_1$ and $Y_1$ of the second subfield (see $P_{RX26}$ and $P_{RX27}$).

As described above, in the method of driving a plasma display panel method according to the present invention, the respective pairs of X and Y electrode lines are driven by pairs of X and Y groups to which they belong (i.e., an AND-logic driving method is performed). Also, since the scan, address, display, and the second driving operations are repeatedly performed, the respective subfields are driven in an overlapping manner. Accordingly, the number of driving devices of X and Y driving circuits can be reduced by an AND-logic driving method, and the luminance of light emitted from the plasma display panel can be enhanced by an address-while-display driving method.

Although a few preferred embodiments of the present invention have been described and shown, it would be appreciated by those skilled in the art that changes and modifications can be made which are within the scope of the invention as defined by the claims and their equivalents.

What is claimed is:

1. A method of driving a plasma display panel having front and rear substrates opposite each other, X and Y electrode lines disposed on the front substrate parallel to each other along a first direction between the front and rear substrates, and address electrode lines disposed on the rear substrate in a second direction orthogonal to the X and Y electrode lines to define corresponding display cells at interconnections across a discharge space, wherein the X electrode lines are divided into X groups and the Y electrode lines are divided into Y groups such that no two adjacent pairs of adjacent X and Y electrode lines belong to the same pair of X and Y groups, and the X and Y electrode lines of the respective X and Y groups are commonly connected to be driven, and at least first and second subfields are driven in an overlapping manner to display gray scales during a unit display period, the method comprising:

a scan operation of applying a Y scan pulse of a first polarity to Y electrode lines of a first pair of the X and Y groups to which a first pair of the X and Y electrode lines of the first subfield belong, and applying an X scan pulse of a second polarity opposite to the first polarity to the X electrode lines of the first pair of X and Y groups to form wall charges in the discharge space around the first pair of X and Y electrode lines;

an address operation of applying a data signal corresponding to the first pair of X and Y electrode lines of the first subfield to the address electrode lines to erase the wall charges formed at unselected discharge cells;

a display operation of alternately applying display pulses to the X and Y electrode lines of the first pair of X and Y groups to cause a display discharge at selected discharge cells where the wall charges are formed;

a second driving operation of performing said scan, address, and display operations for a second pair of X and Y groups to which a second pair of the X and Y electrode lines of a second subfield belong, the address operation for the second pair of the X and Y electrode lines of the second subfield being performed at different timing points than said address operation for the first pair of X and Y electrode lines of the first subfield; and a repetition operation of repeatedly performing said scan, address, display, and second driving operations for pairs of the X and Y groups to which other pairs of the X and Y electrode lines of the first and second subfields belong.

2. The method according to claim 1, wherein said address operation further comprises, while the data pulse for an address signal to erase the wall charges of the unselected discharge cells is applied, applying bias pulses to the X and Y electrode lines of the first pair of X and Y groups to erase additional wall charges from the unselected discharge cells.

3. The method according to claim 2, wherein said display operation further comprises, before the display pulses are applied to the X and Y electrode lines of the first pair of the X and Y groups, applying additional bias pulses to the other X and Y groups, the additional bias pulses having the same polarity and voltage as the bias pulses applied in said address operation and are applied to the X and Y electrode lines of the first pair of the X and Y groups, respectively.

4. The method according to claim 1, wherein said scan operation further comprises, before the scan pulses are applied to the X and Y electrode lines of the first pair of the X and Y groups, applying a reset pulse of the second polarity to the Y electrode lines of the first pair of the X and Y groups and a reset pulse of the first polarity is applied to the X electrode lines of the first pair of the X and Y groups to additionally erase the wall charges.

5. The method according to claim 4, wherein said scan operation further comprises applying a predetermined cease period after applying the reset pulses and before applying the scan pulses to prevent excess space charges from being formed in the discharge space around the first pair of the X and Y electrode lines and to allow a stable state of the space charges.

6. The method according to claim 5, wherein said scan operation further comprises applying cease pulses to appropriately erase the space charges to the X and Y electrode lines of the first pair of the X and Y groups to which the first pair of X and Y electrode lines belong during the cease period.

7. The method according to claim 1, wherein said display operation further comprises, before the respective display pulses are applied to the X and Y electrode lines of the first pair of the X and Y groups, applying auxiliary pulses to the other X and Y groups, the auxiliary pulses having the same polarity and voltage as the scan pulses applied in the scan operation and are applied to the X and Y electrode lines of the first pair of the X and Y groups, respectively.

8. The method according to claim 1, further comprising providing a predetermined cease period after said scan operation is terminated and before said address operation starts to prevent excess space charges from forming in the discharge space around the first pair of the X and Y electrode lines and to allow a stable state of the space charges.

9. The method according to claim 8, wherein said providing the cease period comprises applying cease pulses to appropriately erase the space charges to the X and Y electrode lines of the first pair of the X and Y groups to which the first pair of the X and Y electrode lines belong during the cease period.

10. The method according to claim 1, further comprises providing a predetermined cease period after said address operation is terminated and before said display operation starts to prevent excess space charges from being formed in the discharge space around the first pair of the X and Y electrode lines and to allow a stable state of the space charges.

11. The method according to claim 10, wherein said providing the cease period comprising applying cease pulses to appropriately erase the space discharges to the X and Y electrode lines of the first pair of the X and Y groups to which the first pair of the X and Y electrode lines belong during the cease period.

12. A method of driving a plasma display panel having front and rear substrates disposed opposite each other to define a discharge space in which a gas to form a plasma is sealed, the method comprising:

forming wall charges on the front substrate using scan pulses applied to a first group of X electrode lines and a second group of Y electrode lines, where the X and Y electrode lines are disposed parallel to each other on the front substrate along a first direction, the first and second groups comprise a first common pair of X and Y electrode lines, and the scan pulses applied to the X electrode lines have an opposite polarity to the scan pulses applied to the Y electrode lines;

selectively removing the wall charges using a data signal applied to address electrode lines, where the address electrode lines are disposed on the rear substrate in a second direction non-parallel to the first direction as to define discharge cells in the discharge space at intersections of the address electrode lines and the X and Y electrode lines, such that wall charges of selected discharge cells are removed;

discharging the wall charges at the discharge cells of the first common pair of X and Y electrode lines from which wall charges were not selectively removed;

forming additional wall charges using other scan pulses applied to a third group of X electrode lines and a fourth group of Y electrode lines during said discharging of the wall charges of the selected discharge cells of the first common pair, where the third and fourth group comprise a second common pair of X and Y electrode lines, and the X electrode lines of the third group are not the X electrode lines of the first group or the Y electrode lines of the fourth group are not the Y electrode lines of the second group.

13. The method of claim 12, wherein said discharging the wall charges comprises discharging the wall charges related to a first sub-field, and said forming the additional wall charges comprises forming the additional wall charges related to a second sub-field, where the first and second sub-fields are ones of sub-fields that comprise a unit display period.

14. The method of claim 12, wherein said forming the additional wall charges occurs after said forming the wall charges.

15. The method of claim 12, further comprising alternately applying driving pulses of a same polarity and magnitude to the first and second groups, wherein said forming the wall charges and said selectively removing the wall charges are performed between successive ones of the display pulses applied to the first or second groups.

16. The method of claim 15, wherein said discharging of the wall charges is performed at a next one of the successive display pulses after said selectively removing the wall charges.

17. The method of claim 15, wherein the display pulses have a negative polarity.

18. The method of claim 15, wherein the display pulses have a positive polarity.

19. The method of claim 15, wherein the display pulses are applied to additional X and Y electrode lines in addition to the X and Y electrode lines of the first and second groups.

20. The method of claim 12, further comprising applying bias pulses to the first and second groups during said selectively removing the wall charges, the bias pulses having an opposite polarity to a polarity of the data signal.

21. The method of claim 12, further comprising:

applying reset pulses to the first and second groups prior to said forming the wall charges, wherein the reset pulses applied to the X electrode lines have an opposite polarity to the scan pulses applied to the X electrode lines, and the reset pulses applied to the Y electrode lines have an opposite polarity to the scan pulses applied to the Y electrode lines.

22. A plasma display apparatus, comprising:

a front panel;

a rear panel disposed opposite said front panel to define a discharge space therebetween;

a gas to form a plasma sealed between said front and rear panels in the discharge space;

X and Y electrode lines disposed on said front panel opposite said rear panel in the discharge space, said X and Y electrode lines being parallel to each other, ones of said X and Y electrode lines being interconnected into corresponding groups such that said X or Y electrode lines of each of the groups is commonly driven;

address electrode lines disposed on said rear panel in the discharge space opposite said front panel in a direction not parallel with said X and Y electrode lines, the intersections of said address electrode lines and said X and Y electrode lines defining discharge cells in the discharge space; and X, Y, and address drivers to commonly drive the corresponding groups of said X and Y electrode lines and said address electrode lines using an AND-logic driving method using an address-while-display driving method, wherein said X, Y, and address drivers drive first and second ones of the groups to form wall charges at a first pair of adjacent said X and Y electrode lines common to the first and second groups, drive the first and second groups and said address electrode lines to selectively remove the wall charges except at selected ones of the discharge cells;

drive the first and second groups to discharge the wall charges at the selected discharges cells, and drive third and fourth ones of the groups to form additional wall charges at a second pair of adjacent said X and Y electrode lines while driving the first and second groups to discharge the wall charges.

23. A plasma display apparatus, comprising:

a front panel;

a rear panel disposed opposite said front panel to define a discharge space therebetween:

a gas to form a plasma sealed between said front and rear panels in the discharge space;

X and Y electrode lines disposed on said front panel opposite said rear panel in the discharge space, said X and Y electrode lines being parallel to each other, ones of said X and Y electrode lines being interconnected into corresponding groups such that said X or Y electrode lines of each of the groups is commonly driven;

address electrode lines disposed on said rear panel in the discharge space opposite said front panel in a direction not parallel with said X and Y electrode lines, the intersections of said address electrode lines and said X and Y electrode lines defining discharge cells in the discharge space; and X, Y, and address drivers to commonly drive the corresponding groups of said X and Y electrode lines and said address electrode lines using an AND-logic driving method using an address-while-display driving method, wherein a number of pairs of adjacent said X and Y electrode lines is greater than a number of said X drivers or a number of said Y drivers.

* * * * *